US010961092B2

(12) United States Patent
Delaney et al.

(10) Patent No.: US 10,961,092 B2
(45) Date of Patent: Mar. 30, 2021

(54) PLATFORM HOIST WITH AUTOMATIC EMERGENCY BRAKING SYSTEM

(71) Applicant: JOBOB Investments, Inc., Kennett Square, PA (US)

(72) Inventors: Robert A. Delaney, Kennett Square, PA (US); Kurt B. Stoner, Gap, PA (US); Daniel A. Finley, Gap, PA (US); Nicholas P. Bleiler, Parkesburg, PA (US)

(73) Assignee: JOBOB INVESTMENTS, INC., Kennett Square, PA (US)

( * ) Notice: Subject to any disclaimer, the term of this patent is extended or adjusted under 35 U.S.C. 154(b) by 248 days.

(21) Appl. No.: 16/253,947

(22) Filed: Jan. 22, 2019

(65) Prior Publication Data

US 2019/0233266 A1 Aug. 1, 2019

Related U.S. Application Data

(60) Provisional application No. 62/624,913, filed on Feb. 1, 2018.

(51) Int. Cl.

| | |
|---|---|
| ***B66F 7/02*** | (2006.01) |
| ***B66F 19/00*** | (2006.01) |
| ***E06C 1/38*** | (2006.01) |
| ***B66B 9/193*** | (2006.01) |
| ***E06C 7/12*** | (2006.01) |

(52) U.S. Cl.

CPC ..... *B66F 7/02* (2013.01); *B66B 9/193* (2013.01); *B66F 19/00* (2013.01); *E06C 1/38* (2013.01); *E06C 7/12* (2013.01); *B66F 2700/02* (2013.01)

(58) Field of Classification Search

CPC ..... B66F 7/02; B66F 9/02; B66F 9/00; B66F 9/07581; B66F 9/07509; B62B 2203/07; B62B 2203/073; B62B 2203/10; B62B 2203/70; B62B 2203/72

See application file for complete search history.

(56) References Cited

U.S. PATENT DOCUMENTS

| | | | | | |
|---|---|---|---|---|---|
| 1,482,302 | A * | 1/1924 | Hescock | B66F 9/02 | 192/15 |
| 1,504,415 | A * | 8/1924 | Barrett | B66F 9/02 | 187/243 |
| 1,512,390 | A * | 10/1924 | Young | B66F 9/02 | 187/235 |
| 1,591,719 | A * | 7/1926 | Merrifield | B66F 9/02 | 187/241 |
| 2,981,374 | A * | 4/1961 | Holsclaw | B62B 1/14 | 187/231 |
| 5,433,292 | A * | 7/1995 | Haymore | B66B 5/18 | 187/235 |
| 2019/0023297 | A1* | 1/2019 | Torrison | B62B 1/142 | |

* cited by examiner

*Primary Examiner* — Tyrone V Hall, Jr.
(74) *Attorney, Agent, or Firm* — Stradley Ronon Stevens and Young, LLP

(57) ABSTRACT

An modular lift system for hoisting objects along a track to a predetermined height. The lift system may include a limit switch, a carriage with an automatic emergency braking system, and a peak to engage the track, whereby the carriage rolls along the side rails of the track between the peak mounted to the top of the track and the bottom of the track. The carriage can be adjustable thereby permitting it to be adapted to various types and sizes of tracks. The automatic emergency braking system is adapted to prevent the uncontrolled descent of the carriage in the event of a cable or primary brake failure.

20 Claims, 27 Drawing Sheets

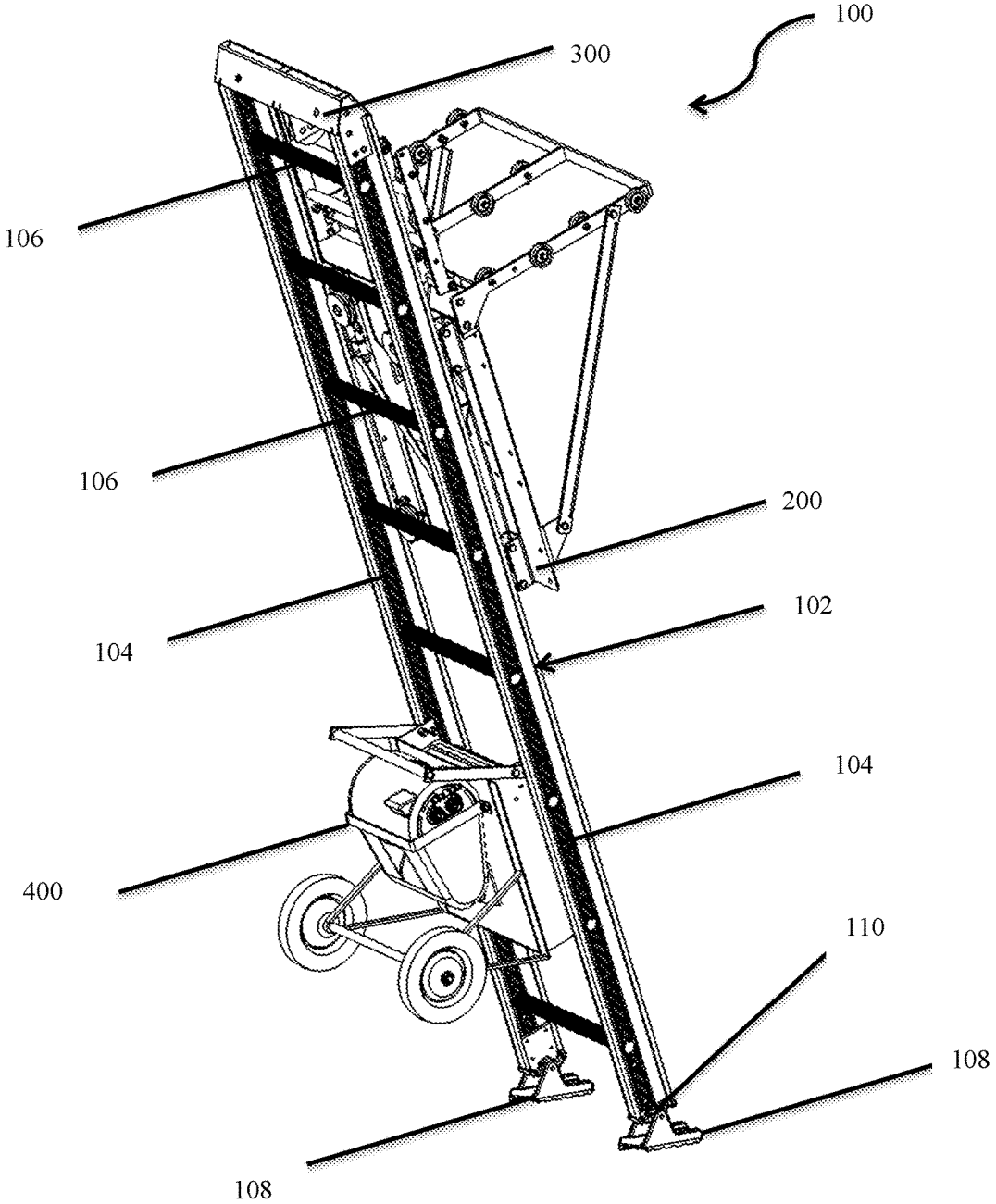
FIG. 1
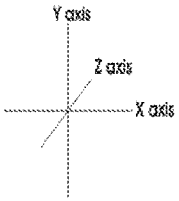

PLATFORM HOIST WITH AUTOMATIC EMERGENCY BRAKING SYSTEM

RELATED APPLICATION

This application claims the benefit of priority to U.S. Provisional Patent Application Ser. No. 62/624,913, filed on Feb. 1, 2018, the contents of which are incorporated in this application by reference.

TECHNICAL FIELD

The present invention generally relates to hoisting systems and, more particularly, to a modular platform lift system that incorporates: a hoist element, a remote control, and an automatic emergency braking system designed to prevent the uncontrolled decent of a platform in the event of a cable or primary brake failure.

BACKGROUND OF THE INVENTION

Ladders are commonly used to assist individuals in moving themselves up or down—typically, to and from the roofs of structures. The Occupational Safety and Health Administration ("OSHA") prohibits manually carrying materials up and down ladders because of the significant dangers associated with falls. This common-sense regulation recognizes that manually carrying heavy objects, such as shingles/bricks/tile or mechanical components such as air conditioners, up a ladder is hazardous. Falls can result in grave injuries and even death. Not to mention, if a contractor is caught in violation of OSHA's regulations, the contractor will likely face large fines.

Decades before OSHA issued these regulations, contractors had already recognized the fall-risk associated with manually carrying materials up ladders. As a result, they turned to platform hoists to assist in transporting material to and from roofs. Such hoists loop a cable over the top of a track allowing the contractor to pull the material up the track either manually or with an internal combustion engine or electric motor with speed reduction. The problem with this approach is that a worker is typically required to remain at the bottom of the track (i.e., underneath the load) to operate the engine using a foot and/or hand lever. This positioning places the worker in extreme danger if the cable or primary brake fails causing the carriage to plunge. Furthermore, the maximum load ratings for platform hoists have increased. It is not uncommon for loads weighing up to 500 pounds to be transported via platform hoists. Such weight not only increases the potential for cable or primary brake failure, but also, the likelihood that the workers below will suffer serious injury or die if they cannot get out of the way of a falling load.

Boom trucks and roofing conveyors negate some of this risk but require significant space, operator training, rental fees, and payment for the inevitable property damage they cause to driveways, lawns, and landscaping due to their size and weight. They are also noisy, hard to maneuver, and ineffective at precisely placing materials where a contractor may want them. Furthermore, they are not environmentally friendly.

Trucks have large engines, many of them diesel powered, that release a significant amount of green-house gases during operation. As consumers become more conscientious of their carbon footprint, they may begin to object to having large noisy engines idling or operating around their house or working on their property.

Accordingly, there is an immediate need for an environmentally friendly platform hoist that incorporates safety apparatuses that removes the operator from the fall zone and prevents carriage plunge when there is a cable or primary brake failure.

BRIEF SUMMARY OF THE INVENTION

To meet this and other needs, and in view of its purposes, an environmentally friendly modular platform hoist with an automatic emergency braking system and remote is disclosed. The automatic emergency braking system does not engage as long as there is tension on a cable connected to a carriage. The tension does not need to be enough to lift the carriage up the track to prevent the engagement of the automatic emergency brake. Indeed, the tension preventing the engagement of the automatic emergency brake, may simply be enough to hold the carriage at a constant height, or less, which would permit the controlled descent of the carriage. If there is a cable or primary brake failure and such tension disappears, the automatic emergency brakes engage to prevent the uncontrolled decent of the carriage and its load.

One non-limiting embodiment of an automatic emergency braking system for a platform hoist includes a carriage frame with a length and a width. The carriage frame has two or more trolley assemblies aligned along opposite lengths of the carriage frame each having two or more truck assemblies with a wheel axially mounted and configured to contact the rails. The carriage frame has an anchor or pulley to connect to a cable used to hoist the carriage frame up and down the track. A platform extends out from the carriage frame. At least two brakes are aligned with the wheels on opposite sides of the carriage frame. Finally, a biasing element that moves between a first position and a second position based on the force exerted on it by the cable is connected to the brakes. As a result, when the cable is in tension and thereby directly or indirectly exerting force on the biasing element the brakes do not contact the wheels. If there is a cable or primary brake failure and the cable is no longer in tension and therefore no longer exerts a force of the biasing element, the biasing element moves to the second position and the brakes contact the wheels to prevent the uncontrolled descent of the carriage.

One non-limiting embodiment of the automatic emergency braking system includes a plate pivot attached to the cable and a spring. In such an embodiment, the spring exerts a constant force on the pivot plate attempting to move it to second position (i.e., engage the brakes). As long as the force exerted by the cable is greater than that exerted by the spring, the plate pivot remains in the first position and the brakes remain unengaged.

In another non-limiting embodiment, the automatic emergency braking system may be manually disengaged which may assist in assembly of the platform hoist. Materials may be unloaded when the carriage reaches the top of the track. The primary brake is what typically holds the carriage at the top of the track. The automatic emergency brake system does not engage unless there is a cable or primary brake failure.

In a further non-limiting embodiment, the disclosed automatic emergency braking system may be incorporated into a hoist system. The hoist system includes a track with a peak at the top of the track through which the cable is strung and a base assembly at the bottom of the track that is used to hoist up the carriage. The length of such a system may be between about 8 feet and about 44 feet.

In another non-limiting embodiment, the automatic emergency brake system, the winch drum and carriage may be modular or adjustable, thereby permitting an operator to construct a material transport apparatus with a specific load profile depending on the specific needs of the operator. In such an embodiment, a carriage frame that is adjustable may be used with tracks having different widths. For example, a carriage may first be used on a ladder rated for 200 pounds. An air conditioner may be heavier than 200 pounds. As a result, the carriage may be removed from the 200 pound rated track and attached to a track that can carry heavier loads, which may itself be wider or narrower than the initial track. Furthermore, a winch drum rated for a heavier or lighter load may be swapped out.

In another non-limiting embodiment, the base assembly, which provides the power to lift the carriage up and down the track may include a power unit attached to a base frame. The base frame may have projections and hooks, configured to permit the base assembly to be attached to the lower end of the tracks, thereby providing an anchor point to assist in raising and lowing the carriage. In such an embodiment, the power unit may also be an electric motor, with the limit switches that typically reside within the motor's housing remotely located outside the motor's housing. Furthermore, the electric motor may be connected to a remote via wired or wireless communication. The advantage of the motor over engines is that motors may run the winch drum in two directions (i.e., the motor may control both the ascent and descent of the carriage). Engines are limited to one direction (i.e., engines may only control the ascent of the carriage).

It is to be understood that both the foregoing general description and the following detailed description are exemplary, but are not restrictive, of the invention.

BRIEF DESCRIPTION OF THE DRAWING

The invention is best understood from the following detailed description when read in connection with the accompanying drawing. It is emphasized that, according to common practice, the various features of the drawing are not to scale. On the contrary, the dimensions of the various features are arbitrarily expanded or reduced for clarity. Included in the drawing are the following figures:

FIG. 1 is a perspective view of one embodiment of a platform hoist including an automatic emergency braking system;

DETAILED DESCRIPTION OF THE INVENTION

Figure 2A:
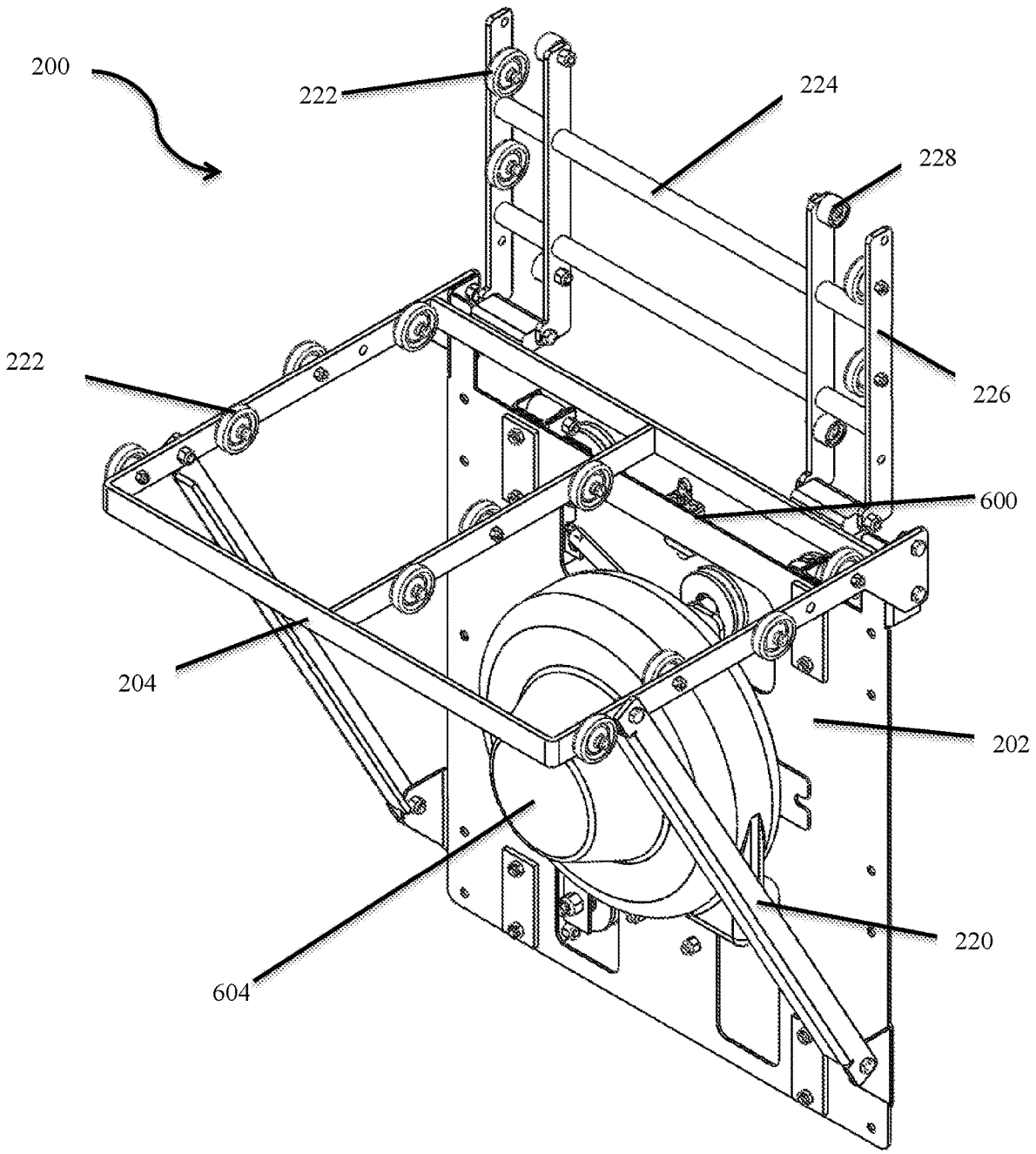
FIG. 2A is a perspective view of the front of one embodiment of the carriage.
Figure 2B:
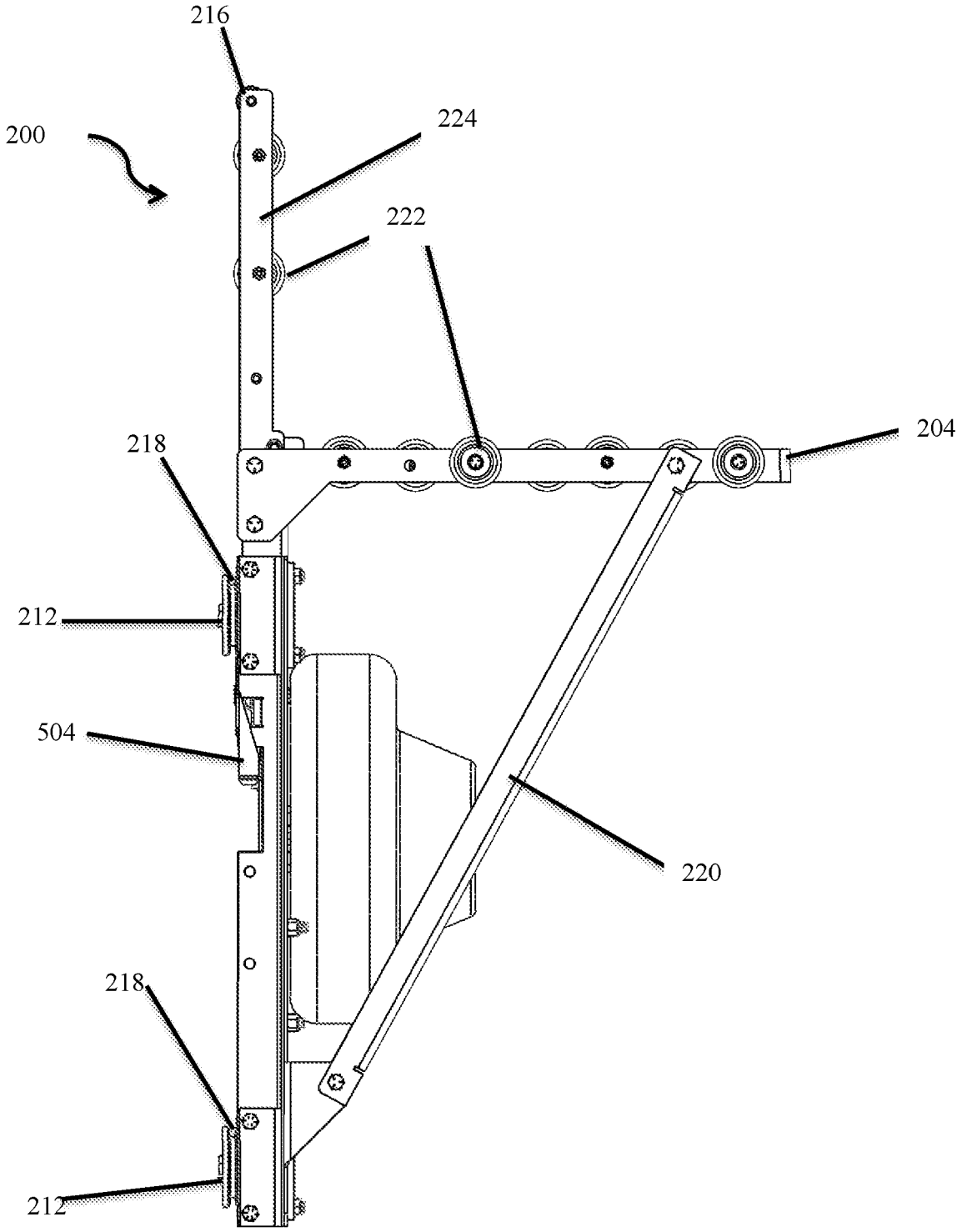
FIG. 2B is a side view of the carriage shown in FIG. 2A.
Figure 2C:
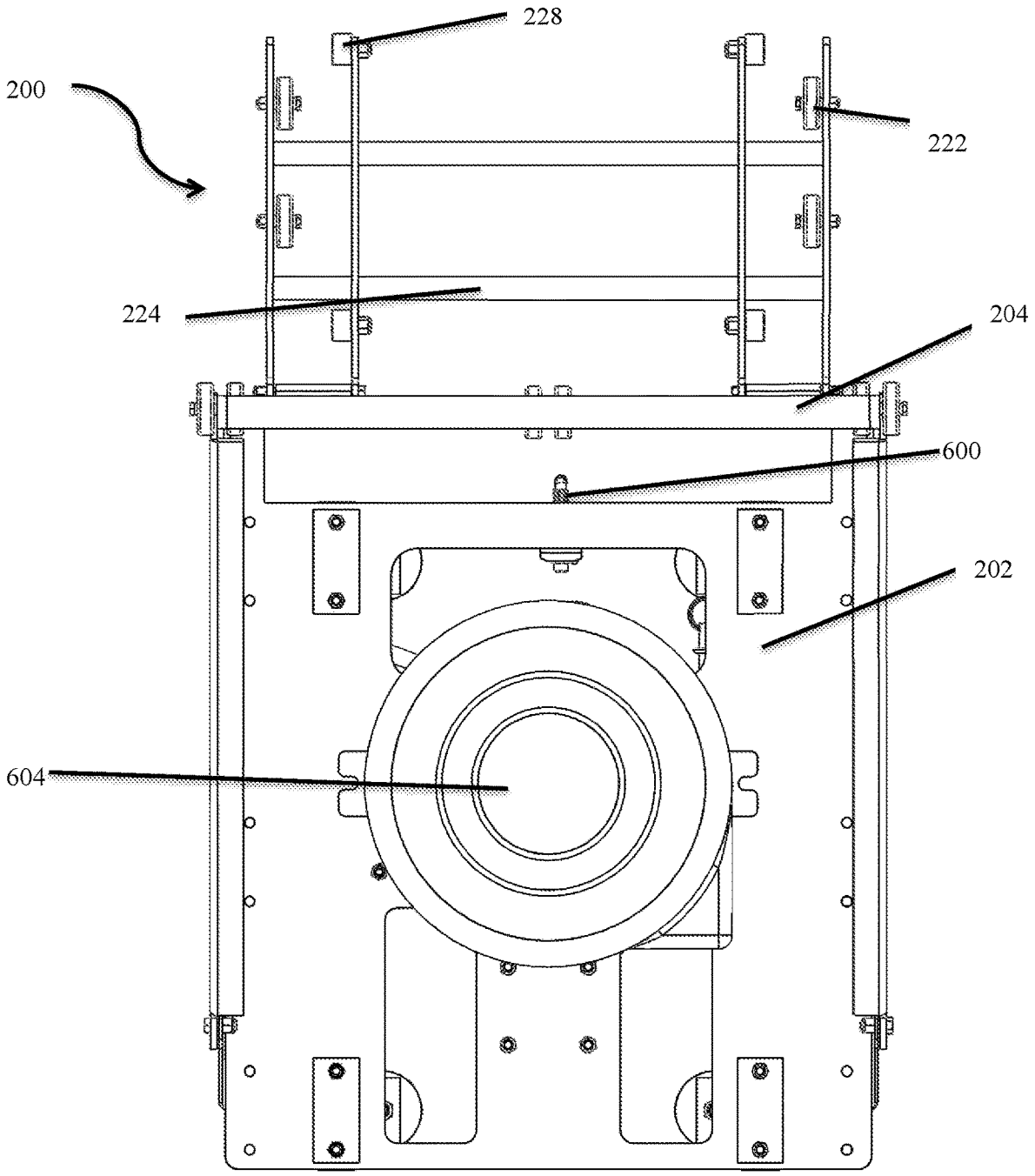
FIG. 2C is a front view of the carriage shown in FIGS. 2A and 2B.
Figure 2D:
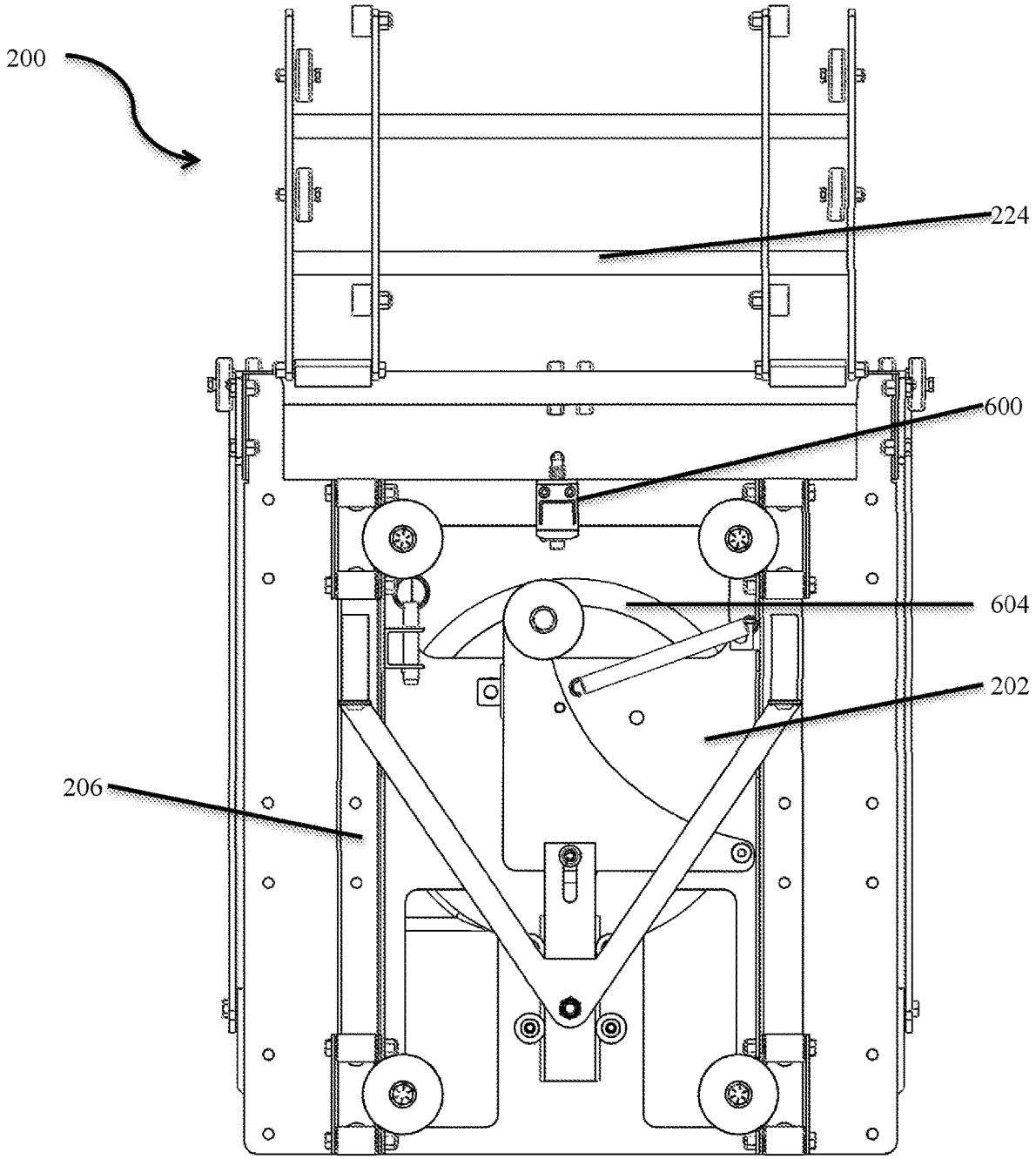
FIG. 2D is a rear view of the carriage shown in FIGS. 2A, 2B, and 2C.
Figure 2E:
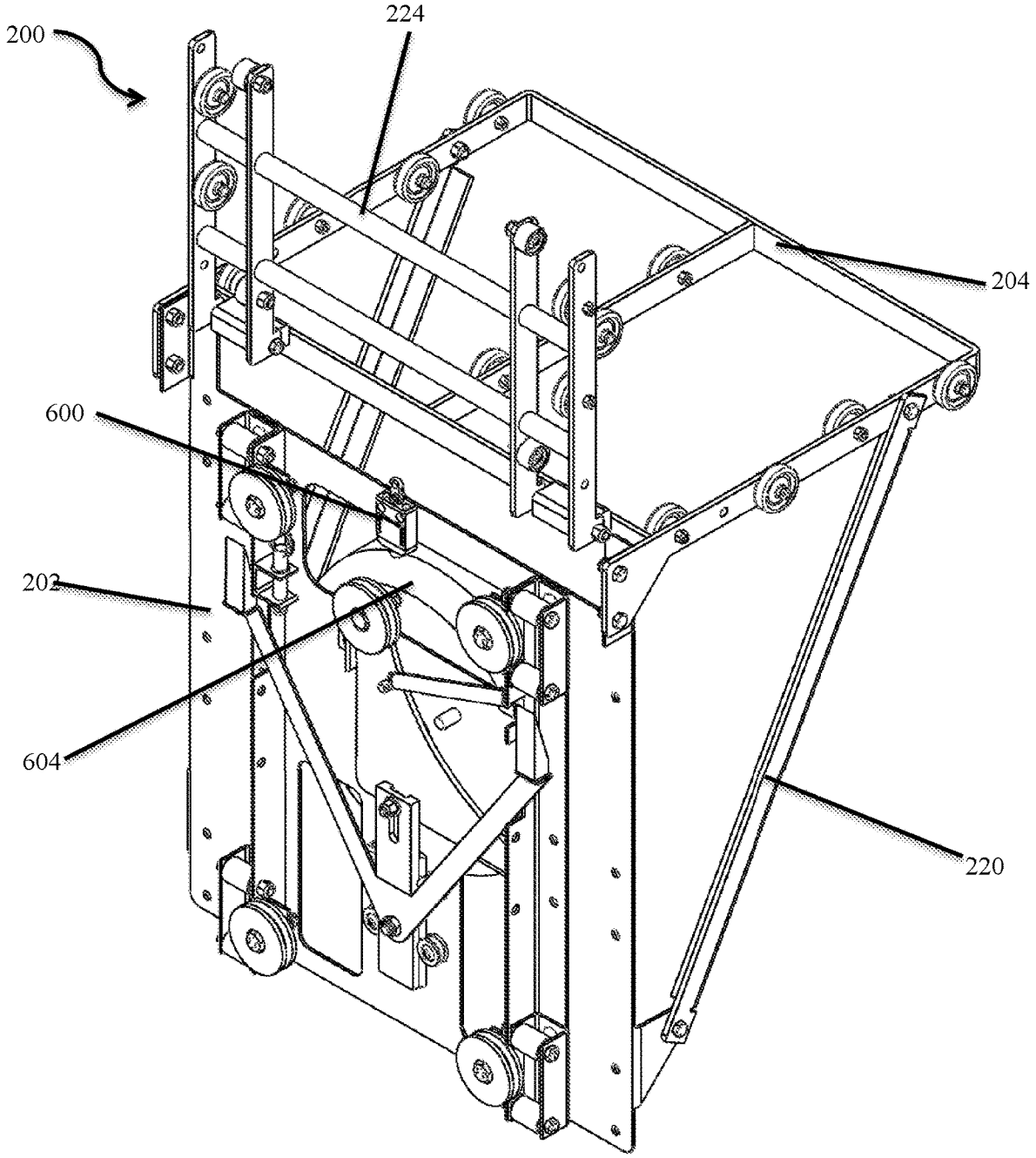
FIG. 2E is a perspective view of the rear of the carriage shown in FIGS. 2A, 2B, 2C, and 2D.

The features and benefits of the disclosed material transport apparatus are illustrated and described by reference to exemplary embodiments. The disclosure also includes the drawing, in which like reference numbers refer to like elements throughout the various figures that comprise the drawing. This description of exemplary embodiments is intended to be read in connection with the accompanying drawing, which is to be considered part of the entire written description. Accordingly, the disclosure expressly should not be limited to such exemplary embodiments illustrating some possible non-limiting combinations of features that may exist alone or in other combinations of features.

In the description of embodiments, any reference to direction or orientation is merely intended for convenience of description and is not intended in any way to limit the scope of the present invention. Relative terms such as "lower," "upper," "horizontal," "vertical," "above," "below," "up," "down," "top," and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be construed or operated in a particular orientation. Terms such as "attached," "affixed," "connected," "coupled," "interconnected," and similar terms refer to a relationship wherein structures are secured or attached to one another either directly or indirectly through intervening structures, as well as both moveable or rigid attachments or relationships, unless expressly described otherwise.

FIG. 1 depicts an exemplary embodiment of the material transport apparatus 100 according to the present disclosure. Preferably materials are transported substantially in the y direction of a conventional Cartesian x-y-z coordinate system. A Cartesian coordinate system (X, Y, Z) is a coordinate system that specifies each point uniquely in three-dimensional space by three Cartesian numerical coordinates, which are the signed distances to the point from three, fixed, mutually perpendicular directed lines, measured in the same unit of length. Each reference line is called a coordinate axis or just an axis of the system, and the point where they meet is its origin, usually at ordered triplet (0, 0, 0). The coordinates can also be defined as the positions of the perpendicular projections of the point onto the three axes, expressed as signed distances from the origin.

In a non-limiting embodiment, the material transport apparatus 100 includes: (1) a track 102; (2) carriage 200, which moves up and down the track 102; (3) a platform 204 extending out from the carriage frame 202; (4) a peak 300 attached to the top of the track 102, through or over which a cable may be looped and attached to the carriage 200; (5) a base assembly 400, which is connected to the cable and provides the force necessary to lift the carriage 200, along with materials placed thereon, up the track 102; (6) an automatic emergency brake system 500, which prevents the uncontrolled descent of the carriage 200 in the event of a cable or primary brake failure; and (7) a limit switch 600, which prevents the carriage 200 from causing damage to the peak 300 or overrunning the top of the track 102.

In one non-limiting embodiment, the carriage 200 along h the automatic emergency brake system 500 have an adjustable width so they may engage with tracks 102 having different widths. The ability to work with tracks 102 of different widths may provide cost savings.

In another non-limiting embodiment, the base assembly 400 includes a winch drum assembly 424 containing a modular cable drum 430. The cable drum 430, may be modular allowing it to be replaced with a cable drum 430 rated for higher or lower loads depending on the needs of the operator.

In another non-limiting embodiment, the track 102 is comprised of standardized pieces that may be joined together to increase the length of the track 102.

The automatic emergency braking system 500 further includes a biasing element 502 connected to the braking elements 504 and adapted to be moved between a first position and a second position by a pulling force aligned in the direction of the length of the track 102. In the automatic emergency braking system 500, when the biasing element 502 is in the first position the braking elements 504 do not contact the wheels 212 and when the biasing element 502 is the second position the braking elements 504 contact the wheels 212.

To disengage the braking elements 504, there must be some tension applied to the cable attached to the carriage 200. To prevent the engagement of the automatic emergency brake 500, the tension does not need to be enough to lift the carriage 200 up the track 102. Indeed, the cable tension preventing the engagement of the automatic emergency brake 500, may simply be enough to hold the carriage 200 at a constant height. The tension on the cable may even be so slight that the carriage 200 descends the track 102 in a controlled manner. In addition, when the platform 204 and materials reach the top of the track 102, the materials may be unloaded, and the carriage 200 may be lowered back down the track 102, again, in a controlled manner. Because of the automatic emergency braking system 500, the present disclosure is safer than current platform hoists.

In another embodiment, the flap 224 pivots between a substantially vertical and substantially horizontal position so that as the carriage 200 ascends the track 102 the flap 224 is in a substantially parallel to the length of the track 102. However, when the carriage 200 reaches the top of the track 102 the flap 224 may pivot to a position that is substantially perpendicular to the length of the track 102. Such a position may also be substantially planar with the platform 204. Such a change in position by the flap 224 may assist with unloading.

Track

One aspect of the present invention is directed to a track 102 having a length and a width. A track 102 may be defined as at least a pair of spaced side rails 104 defining a length and a plurality of rungs 106 extending between the side rails 104 defining the width.

The side rails 104 may be in the shape of an I-beam with two substantially parallel flanges connected by a web.

The rungs 106 may be round. Supports may be attached to the rungs 106, or the rungs 106 may contain supports. Such supports may be internal or external to the rungs 106. Such supports may increase the load rating for the rungs 106. Furthermore, the rungs 106 which contain internal supports may be identified by either color, shape, texture, by affixing a design to the specific rung 106, or any combination thereof. The supports may be attached to every rung 106, every other rung 106, or every third rung 106.

The track 102 may be a single piece or multiple pieces joined together. Multiple pieces may be joined by fasteners and splice plates.

The multiple track 102 pieces may have standardized heights and widths to permit easy joinder. Such sections may be between about 3 and about 8 feet in length. The sections are typically about 8 feet in length and the pieces may form a track 102 having a length between about 8 feet and about 44 feet.

The track 102 may be removably attached to the side or roof of a structure. The track 102 may be configured to contact a support bracket at or near the top of the track 102. Such a support bracket may stabilize the track 102. Such a support bracket may be attached with fasteners, and the track 102 may include apertures, which may or may not be threaded, to engage such fasteners.

In addition, a brace may be attached to both the track 102 and the side of a structure, the track 102 and the ground, or the track 102, the side of the structure, and the ground. The brace may be attached anywhere between the top of the track 102 and the bottom of the track 102. In a non-limiting embodiment, the brace is attached at substantially the center of the track 102. The brace may provide added stability to the track 102. Furthermore, the brace may increase the load rating of the track 102. To protect against the bowing of a track 102 with a height greater than 28 feet, a brace may used.

The bottom of the track 102 may include feet 108 which may provide for more stability. The feet 108 may be connected to the bottom of the track 102 at a foot pivot 110. Such a foot pivot 110 may permit the feet 108 to rotate on an axis that is substantially perpendicular to the length of the track 102. Feet 108 that can pivot may provide the track 102 with more stability.

Carriage

One aspect of the present invention is directed to a carriage 200 including an automatic emergency braking system 500 attached to a carriage frame 202.

FIGS. 2A, 2B, 2C, 2D, and 2E depict one embodiment of a carriage 200. The carriage 200 includes a platform 204 extending out from a carriage frame 202. In a non-limiting embodiment, the carriage frame 202 may be a frame with an aperture in the middle. Conversely, the carriage frame 202 may comprise a solid plate. Furthermore, the carriage frame 202 may also be a plate with holes or apertures as depicted in FIGS. 2A, 2B, 2C, 2D and 2E. Such holes or apertures may or may not be threaded and may or may not pass entirely through the plate. The holes or apertures may also accept fasteners or ties to secure the materials loaded onto the platform 204.

Due to the substantial weights that the carriage 200 is adapted to support, in certain embodiments, the carriage frame 202 and/or platform 204 may include stiffener plates. Such stiffener plates may be additional sheets of metal attached along the carriage frame 202 and/or platform 204 and adapted to resist twisting or bending of the carriage frame 202 and/or platform 204.

Adjustable Trolley Assembly

Figure 2F:
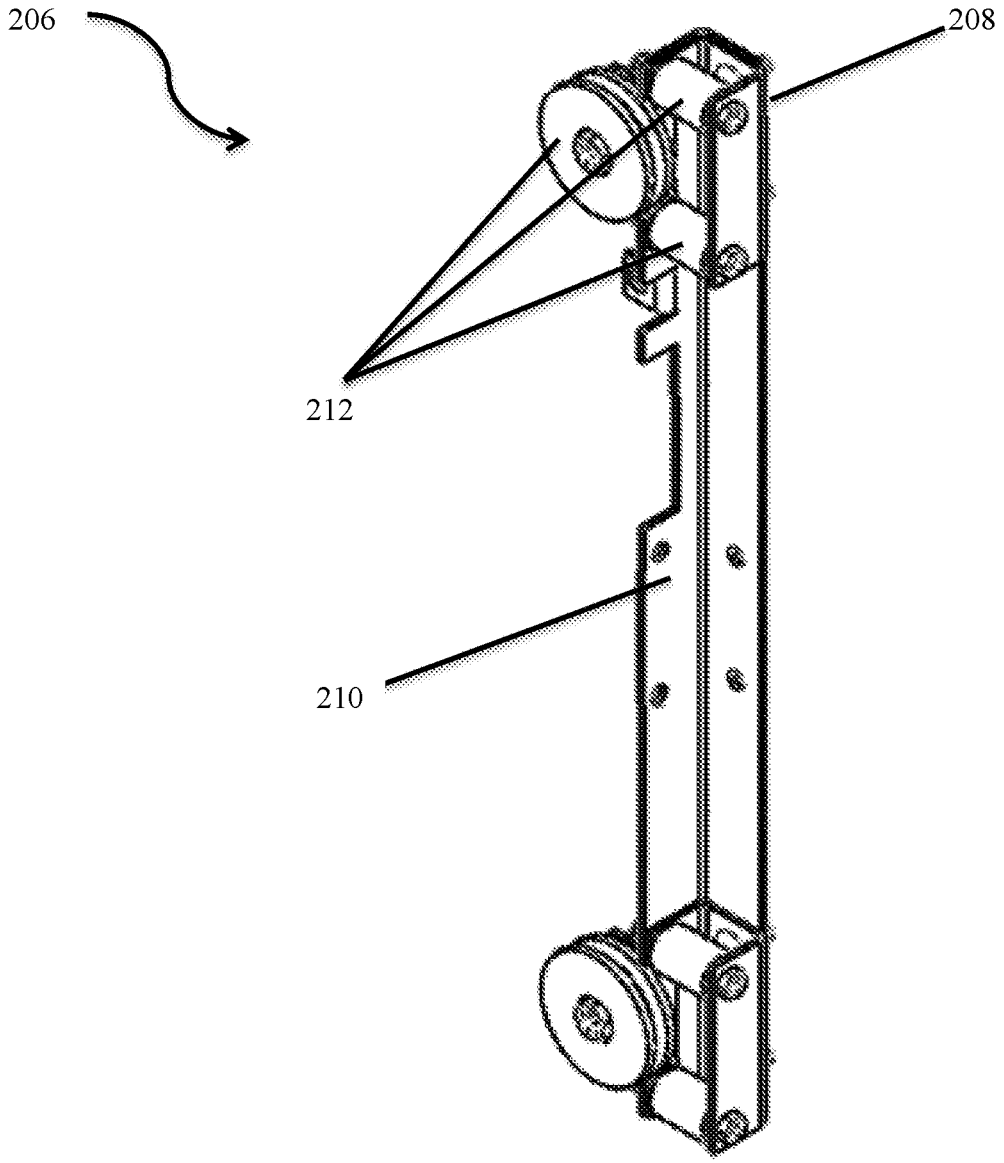
FIG. 2F is a perspective view of one embodiment of the trolley assembly including one embodiment of truck assemblies.
Figure 2G:
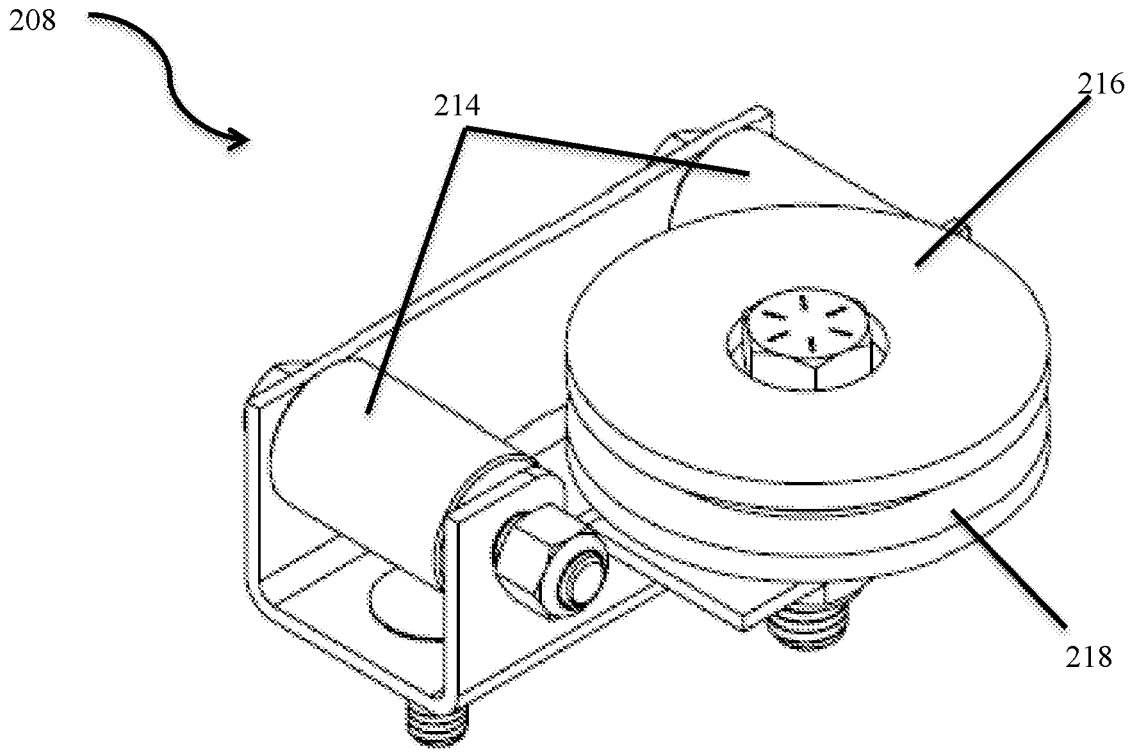
FIG. 2G is a perspective view the truck assemblies of FIG. 2F.

The carriage frame 202 is attached to two trolley assemblies 206 configured to be aligned with the length of the track 102. FIG. 2F depicts a non-limiting embodiment of a trolley assembly 206.

One trolley assembly 206 is closer to one edge of the carriage frame 202. The other trolley assembly 206 is closer to a second edge of the carriage frame 202. The distance between each trolley assembly 206 is adjustable, which may permit the same carriage 200 to travel on tracks 102 having different widths. For example, a carriage 200 may be removed from tracks 102 having a first width, the location of the trolley assemblies 206 on the carriage 200 may then be adjusted thereby permitting the carriage 200 to then be used on a length of track 102 having a second width.

Truck Assembly

Each trolley assembly 206 includes at least one truck assembly 208 attached to a guide 210. Each truck assembly 208 has at least one wheel 212. The wheel 212 may have an axis of rotation: (1) substantially parallel to the width of the carriage 200 (e.g., carriage wheels 214), (2) substantially perpendicular to both the width and height of the carriage 200 (e.g., guide wheels 216), or (3) at a hybrid angle that is neither substantially parallel nor substantially perpendicular to the width or height of the carriage 200 (e.g., at a 45° angle from the plan created by the length and width of the carriage frame 202). In such a hybrid configuration a brake caliper may enclose a portion of the wheel 212.

The distance between the wheels 212 and the guides 210 may be great enough to permit at least a portion of a side rail 104 of the track 102 to pass between the wheel 212 and a portion of the guide 210. Conversely, the rim of the wheel 212 may be concave or include a groove 218 which may allow the rim to partially pass through an aperture of the guide and partially encase the interior or exterior edge of a flange of the side rail 104.

Each truck assembly 208 may be attached at the top or bottom of the trolley assembly 206 or anywhere in between the top and the bottom, such as, in the middle of the trolley assembly 206.

Each trolley assembly 206 may include up to four truck assemblies 208. Each truck assembly 208 may include two carriage wheels 214 and one guide wheel 216.

Platform

The platform 204 is connected to and extends outward from the carriage frame 202. In a non-limiting embodiment, the platform 204 includes at least two support arms 220. Furthermore, the platform 204 may be a frame as depicted in FIGS. 2A, 2B, 2C, 2D, and 2E. Conversely, the platform 204 may comprise a solid plate. Furthermore, the platform 204 may also be a plate with holes or apertures. Holes or apertures in the platform 204 also may or may not pass through the platform 204. The holes or apertures may also accept fasteners or ties to secure the materials loaded onto the platform 204.

The carriage may have at least one platform support arm 220. The platform support arm 220 may connect the carriage frame 202 to the platform 204.

The platform 204 may also include skate wheels 222. The platform 204 contains between two and twelve skate wheels 222. In one embodiment, the platform 204 contains 11 skate wheels 222. In another embodiment, the platform 204 contains 7 skate wheels 222.

Flap

A flap 224 may be attached to either the platform 204 or the carriage frame 202. In a non-limiting embodiment, the flap 224 includes at least two support arms 226. Furthermore, the flap 224 may be a frame as depicted in FIGS. 2A, 2B, 2C, 2D, and 2E. Conversely, the flap 224 may comprise a solid plate. Furthermore, the flap 224 may also be a plate with holes or apertures. Such holes or apertures may or may not be threaded so as to permit materials placed against the flap 224 to be further secured with straps or fasteners. Holes or apertures in the flap 224 also may or may not pass through the flap 224. The flap 224 may also contain skate wheels 222 or guide wheels 228.

In one embodiment, the flap 224 is attached to the carriage frame 202 at a pivot. Thus permitting the flap 224 to be in a substantially vertical position when the carriage 200 is ascending the track 102 and in a substantially horizontal position when the carriage 200 reaches the top of the track 102.

The flap 224 may also contain between two and twelve skate wheels 222 and two and twelve guide wheels 228. In one embodiment, the flap 224 contains 4 skate wheels 222. In another embodiment, the flap 224 contains 4 guide wheels 228. Skate wheels 222 may assist with the loading and offloading of materials, whereas, guide wheels 228 may contact the track 102 and assist with the movement of the carriage 200 up and down the track 102.

Carriage Cable Anchor

Figure 5A:
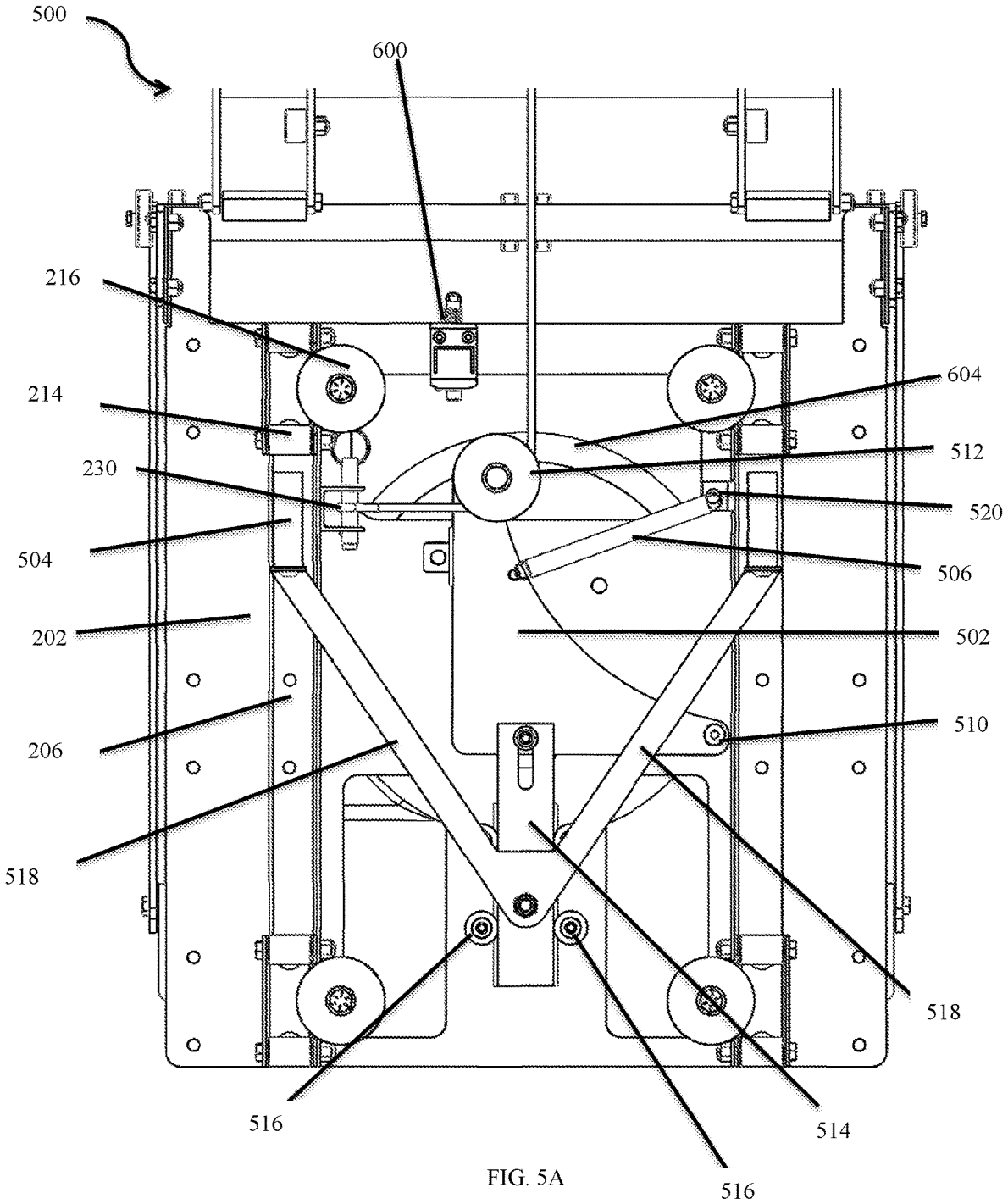
FIG. 5A is front view of one embodiment of the automatic emergency braking system with the brake element disengaged.
Figure 5B:
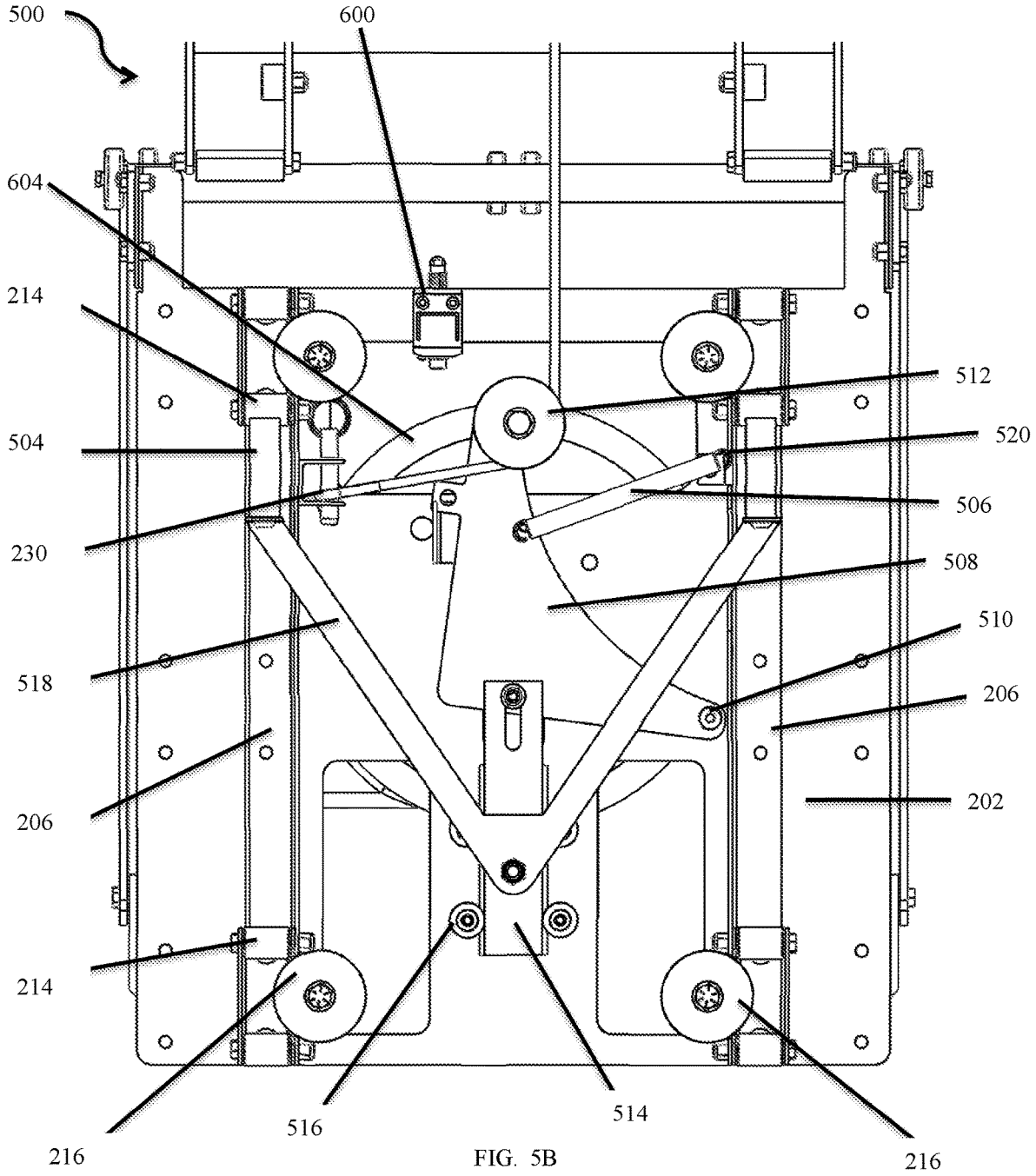
FIG. 5B is front view of the automatic emergency braking system shown in FIG. 5A with the brake element engaged.

Finally, the carriage frame 202 or the peak 300 may include an anchor 230 configured to accept a cable. An example of an anchor on a carriage frame 202 is illustrated in FIGS. 5A and 5B.

In another non-limiting embodiment, a pulley attached to the carriage frame may act as an anchor 230. For example, the cable may be double strung (i.e., a cable may be run from the base assembly 400 up through the peak 300 down through a pulley attached to the cable frame 202 and finally back up and attached to the peak 300).

The anchor 230 permits a cable to be attached and force to be applied by the cable on the carriage 200 substantially in the direction of the length of the carriage 200. In one embodiment, the anchor 230 may be located closest to the edge of the carriage frame 202 that is furthest from the platform 204. In another embodiment, the anchor 230 is located closest to the edge of the carriage frame 202 that is closest to the platform 204. In a further embodiment, the anchor 230 is located closest to the edge of the carriage frame 202 that is closest to a length of the track 102. In another embodiment, the anchor 230 is located in the center of the carriage frame 202. In a further embodiment, a pulley may act as an anchor 230 on the carriage frame and the cable may be terminally anchored at the peak (e.g., double strung).

Automatic Emergency Braking System

One aspect of the present invention is directed to an automatic emergency braking system 500 attached to the carriage frame 200. The automatic emergency braking system 500 is designed to prevent an uncontrolled decent of the carriage 200 in the event of a cable or primary brake failure.

Figure 5C:
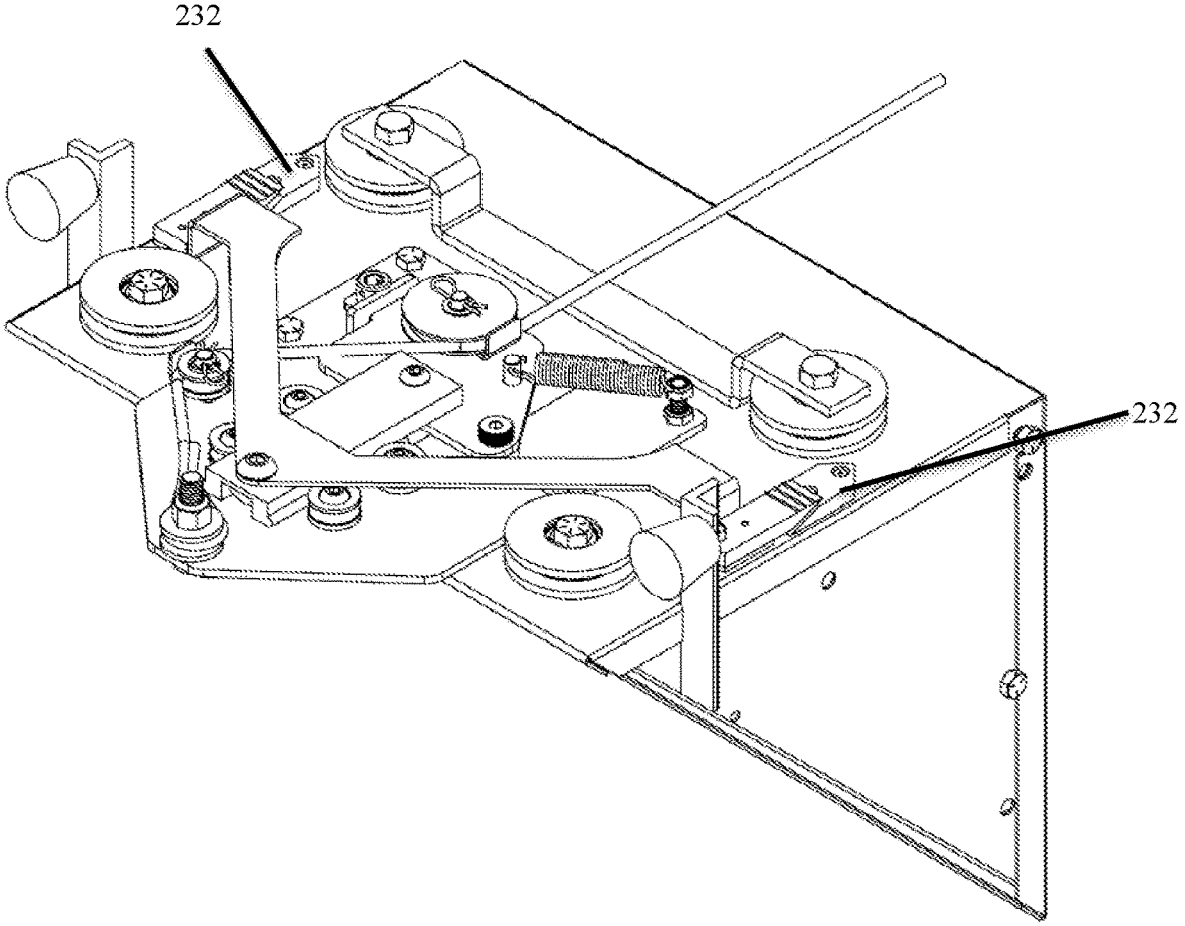
FIG. 5C is a perspective view of one embodiment of the automatic emergency braking system with the brake element disengaged.
Figure 6A:
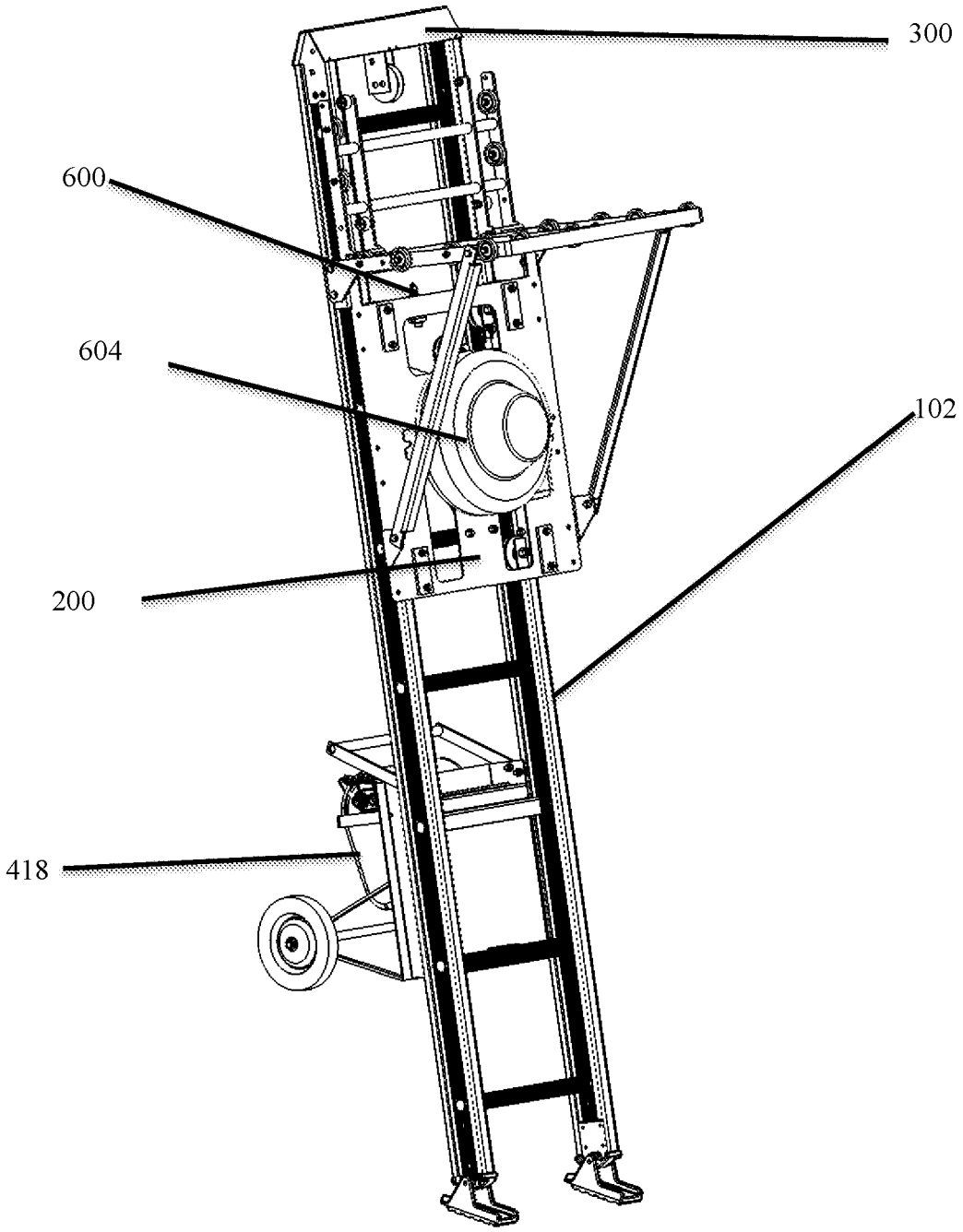
FIG. 6A is a perspective view of one embodiment of a platform hoist.
Figure 6B:
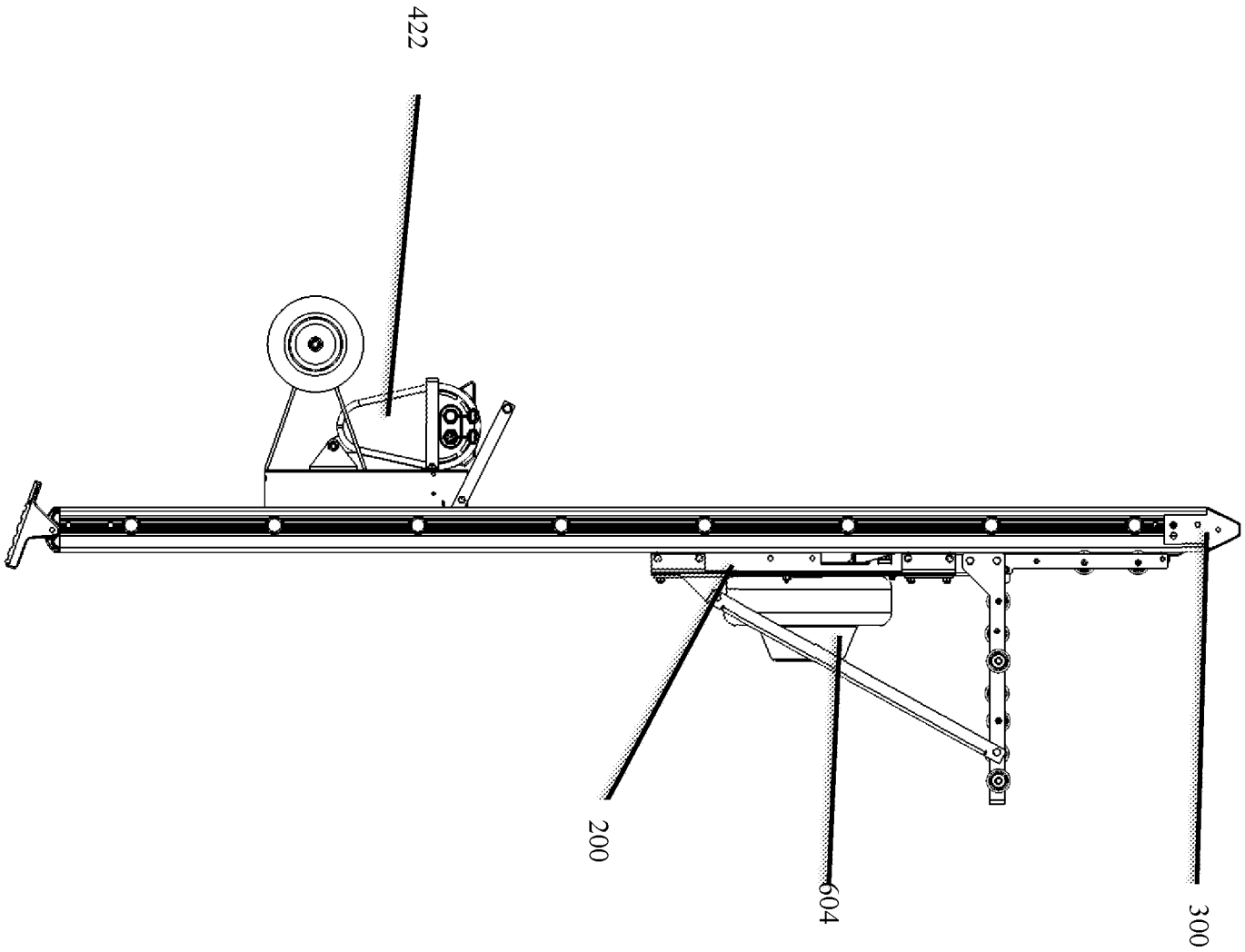
FIG. 6B is a side view of the platform hoist shown in FIG. 6A.
Figure 6C:
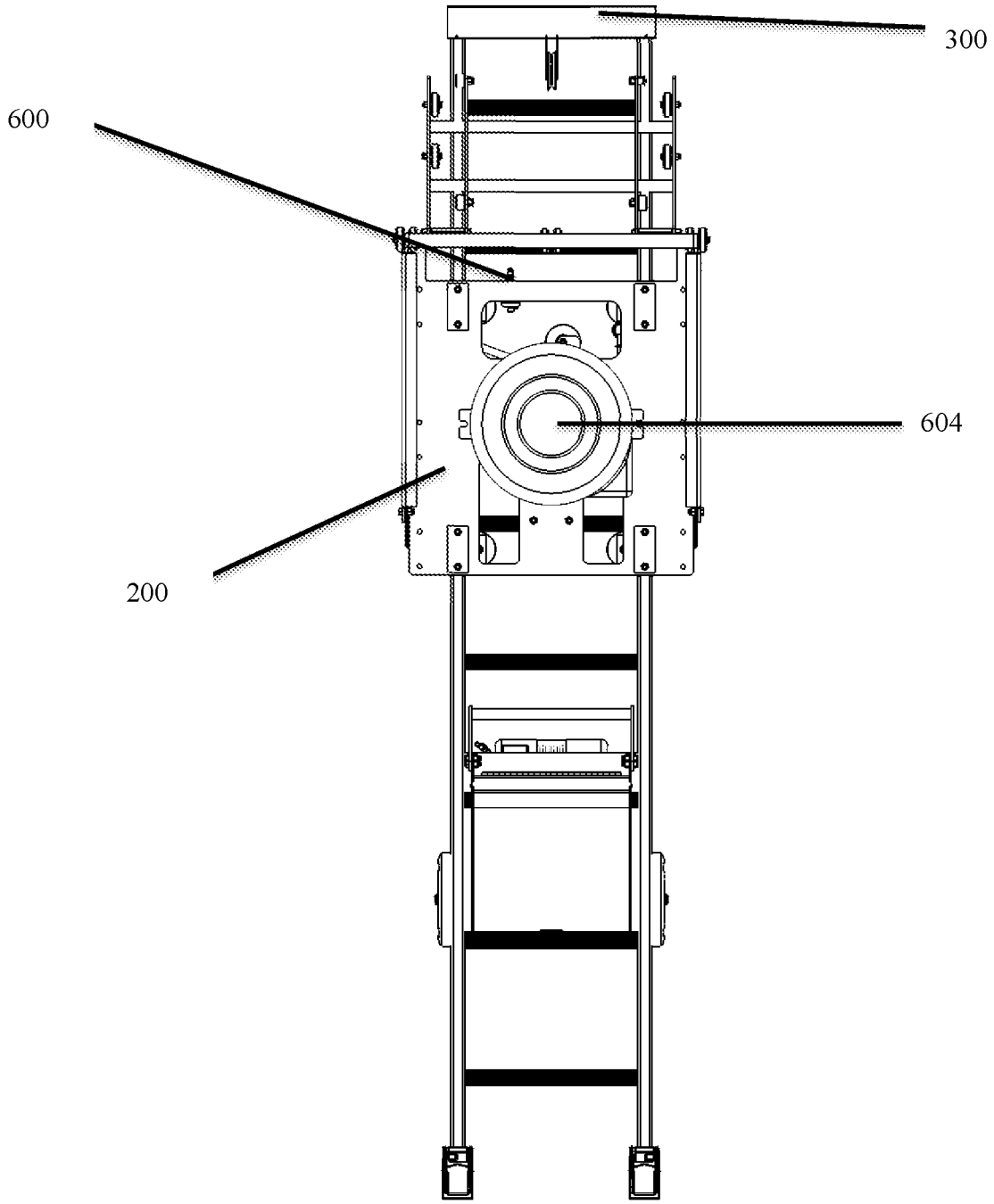
FIG. 6C is a front view of the platform hoist shown in FIGS. 6A and 6B.
Figure 7A:
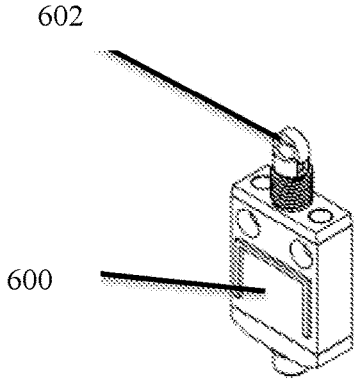
FIG. 7A is a perspective view of one embodiment of a limit switch.
Figure 7B:
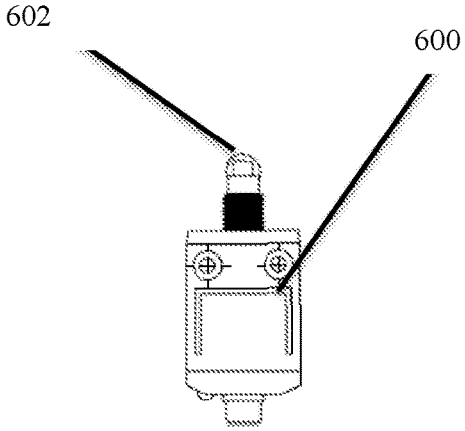
FIG. 7B is a front view of the limit switch shown in FIG. 7A.
Figure 7C:
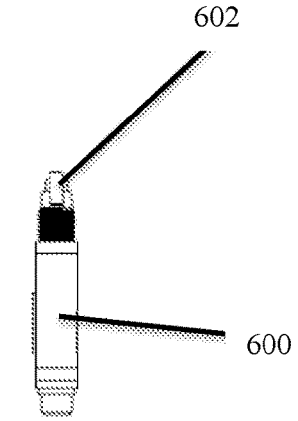
FIG. 7C is a side view of the limit switch shown in FIGS. 7A and 7B.

Non-limiting embodiments of the automatic emergency braking system 500 are depicted in FIGS. 5A, 5B, and 5C. In such embodiments, the automatic emergency braking system 500 employs a biasing element 502 which is adapted to be moved between a first position and a second position. The biasing element 502 may be a pivot that moves between two positions as a result of the application of at least one force placed on the biasing element 502 in a specific direction. For example, the force applied on the biasing element 502 by a cable substantially in the direction of the length of the carriage 200 may keep the biasing element 502 in a first position so the braking element 504 of the automatic emergency braking system 500 remains disengaged from the wheels 212, as depicted in FIG. 5A. When the force of the cable is removed, the biasing element 502 may transition to a second position resulting in the braking element 504 of the automatic emergency braking system 500 engaging with the wheels 212, as depicted in FIG. 5B.

The biasing element 502 may be further subjected to a second force in the direction of the second position of the biasing element 502. Such a force may be constant and applied by a spring element 506. In this manner a spring element 506 may be included in the automatic emergency braking system 500 to place a constant force on the biasing element 502 in the direction of a second position. In such a non-limiting embodiment, when the cable force is greater than the spring force the braking elements 504 do not engage the wheels 212. When the spring force is greater than the cable force the braking elements 504 engage the wheels 212.

In a non-limiting embodiment, the biasing element 502 may be a plate 508 attached to the carriage frame 202 at a pivot 510. A force transfer element 512 may be employed to redirect the force applied by the cable substantially in the direction of the length of the carriage 200 onto the biasing element 502 substantially in the direction of the first position (i.e., disengage the braking elements 504). The force transfer element 512 may be a pulley or projection, for example.

The biasing element 502 may be connected to the braking elements 504 by a slide 514. The slide 514 may be held in place between slide rollers 516. As the biasing element 502 moves between the first and second position the slide 514 moves up and down accordingly. The slide 514 may be further connected to the braking elements 504 by at least one brake arm 518. The spring element 506, which may be an extension spring, is attached to the trolley assembly 206 of the carriage frame 202 or the carriage frame itself 202 by an anchor pin 520 and to the plate 508 via an aperture or hole.

The braking elements 504 are aligned with the wheels 212 so as the biasing element 502 moves from the first position to the second position the braking elements 504 contact the wheels 212. In addition, the braking elements 504 may assume many shapes: for example, square, rectangular, inverted semi-circle, inverted triable, or wedge shaped. In one embodiment, the braking elements 504 are wedge shaped.

In certain other embodiments, the automatic emergency braking system includes wedge plates 232 opposite the braking elements 504. An example of one embodiment of a wedge plate 232 is depicted in FIG. 5C. Such wedge plates may be adapted to engage with the braking elements 504 and direct the braking elements towards the track 102.

The braking elements 504 may also be made out of metal or ceramic. In one embodiment, the braking elements 504 are made of a metal harder than aluminum (e.g., steel) and serrated. In one embodiment, the braking elements 504 are wedge shaped where the leg of the braking element that contacts the track 102 is serrated. The leg that contacts the track 102 may be aligned whereby the serrated leg contacts the face of a flange of the track 102. Conversely, in another embodiment, the leg that contacts the track 102 may be aligned whereby the serrated leg contacts the edge of a flange of the track 102.

Peak

One aspect of the present invention is directed to a peak 300 that is attached to the top of the track 102 through or over which a cable may be looped and attached to the carriage 200 at the anchor 230.

Figure 3A:
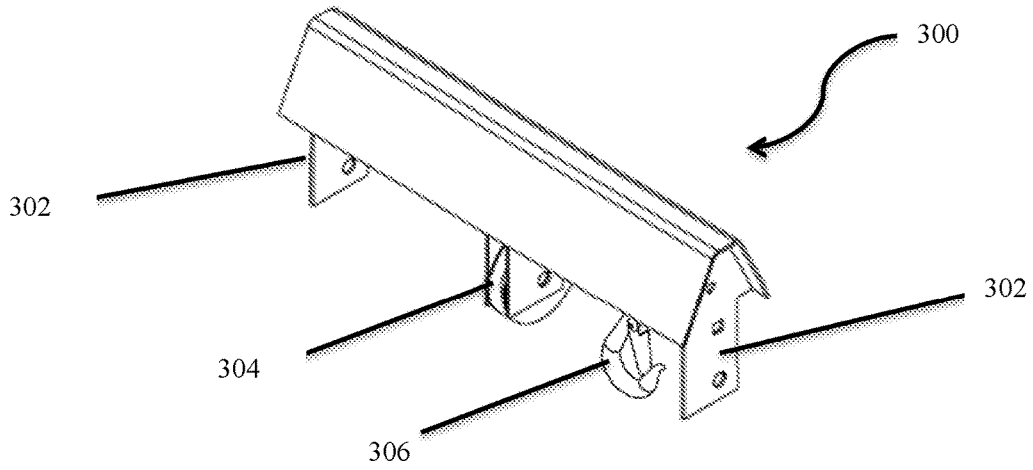
FIG. 3A is a perspective view of one embodiment of a peak.
Figure 3B:
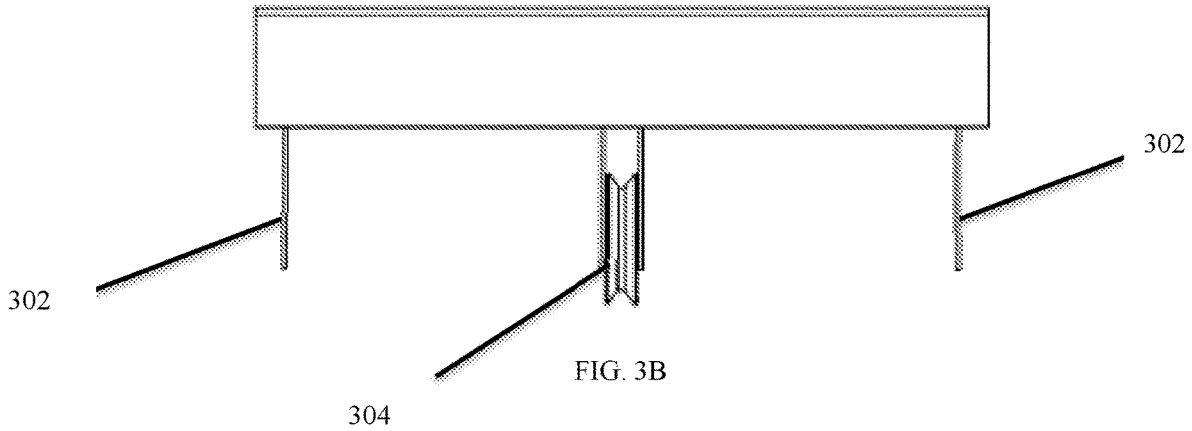
FIG. 3B is a front view of the peak shown in FIG. 3A.
Figure 4A:
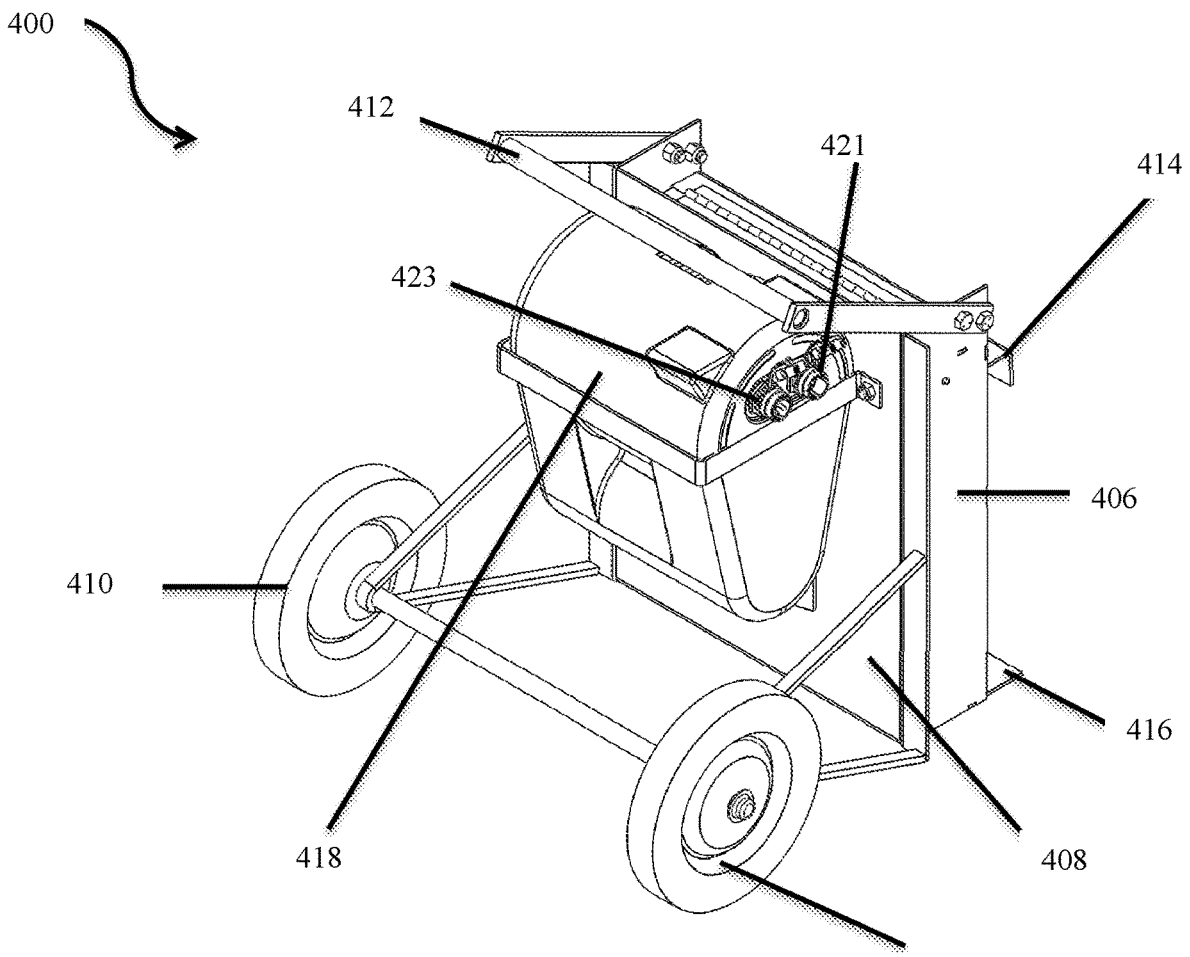
FIG. 4A is a perspective view of the rear of one embodiment of a base assembly.
Figure 4B:
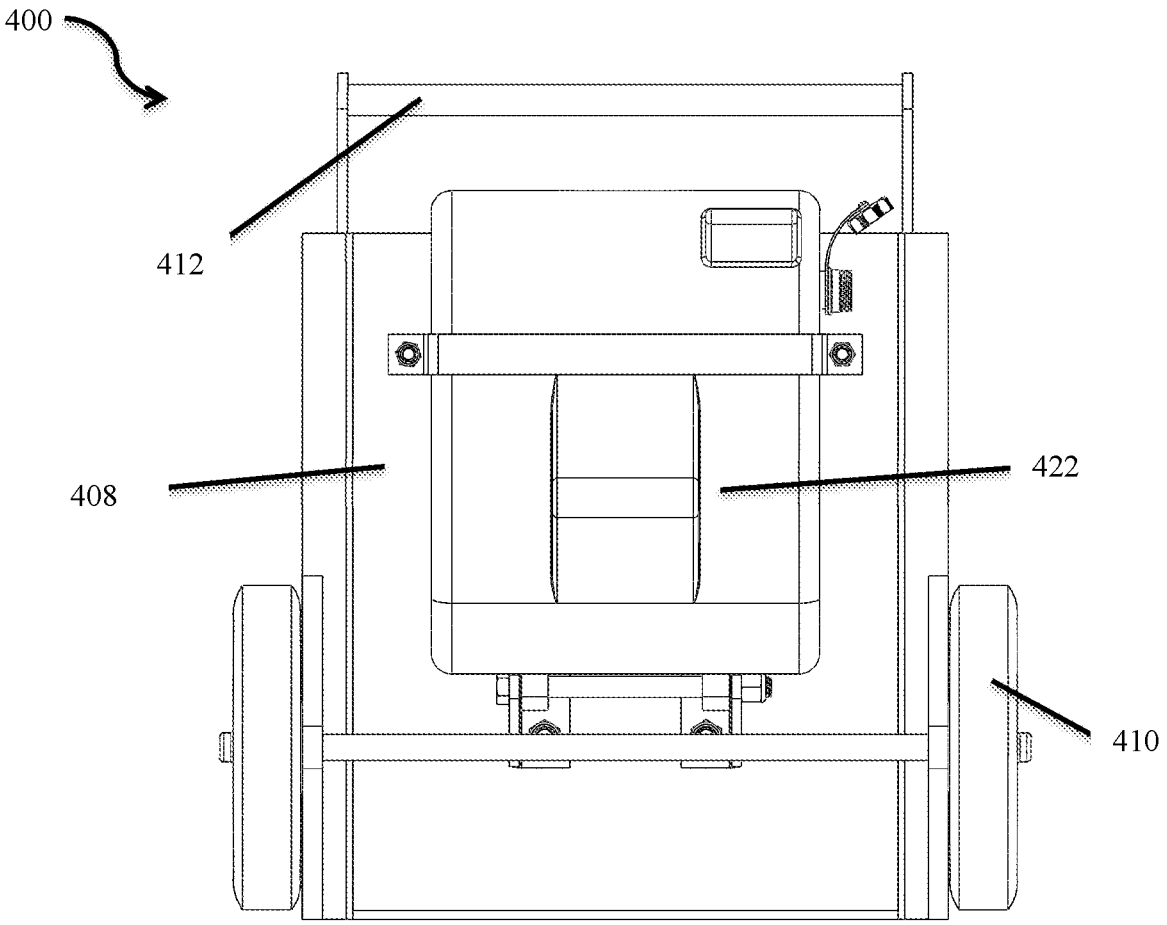
FIG. 4B is a rear view of the base assembly shown in FIG. 4A.
Figure 4C:
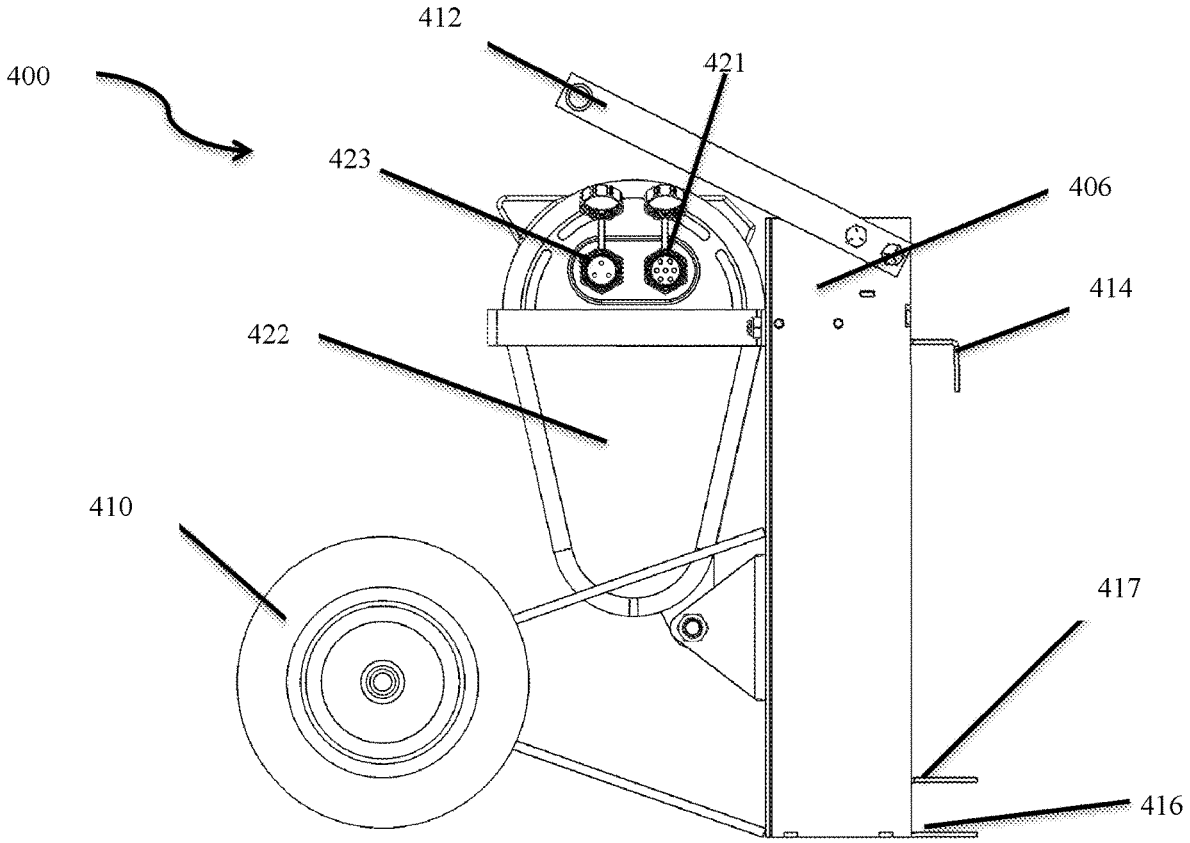
FIG. 4C is a side view of the base assembly shown in FIGS. 4A and 4B.
Figure 4D:
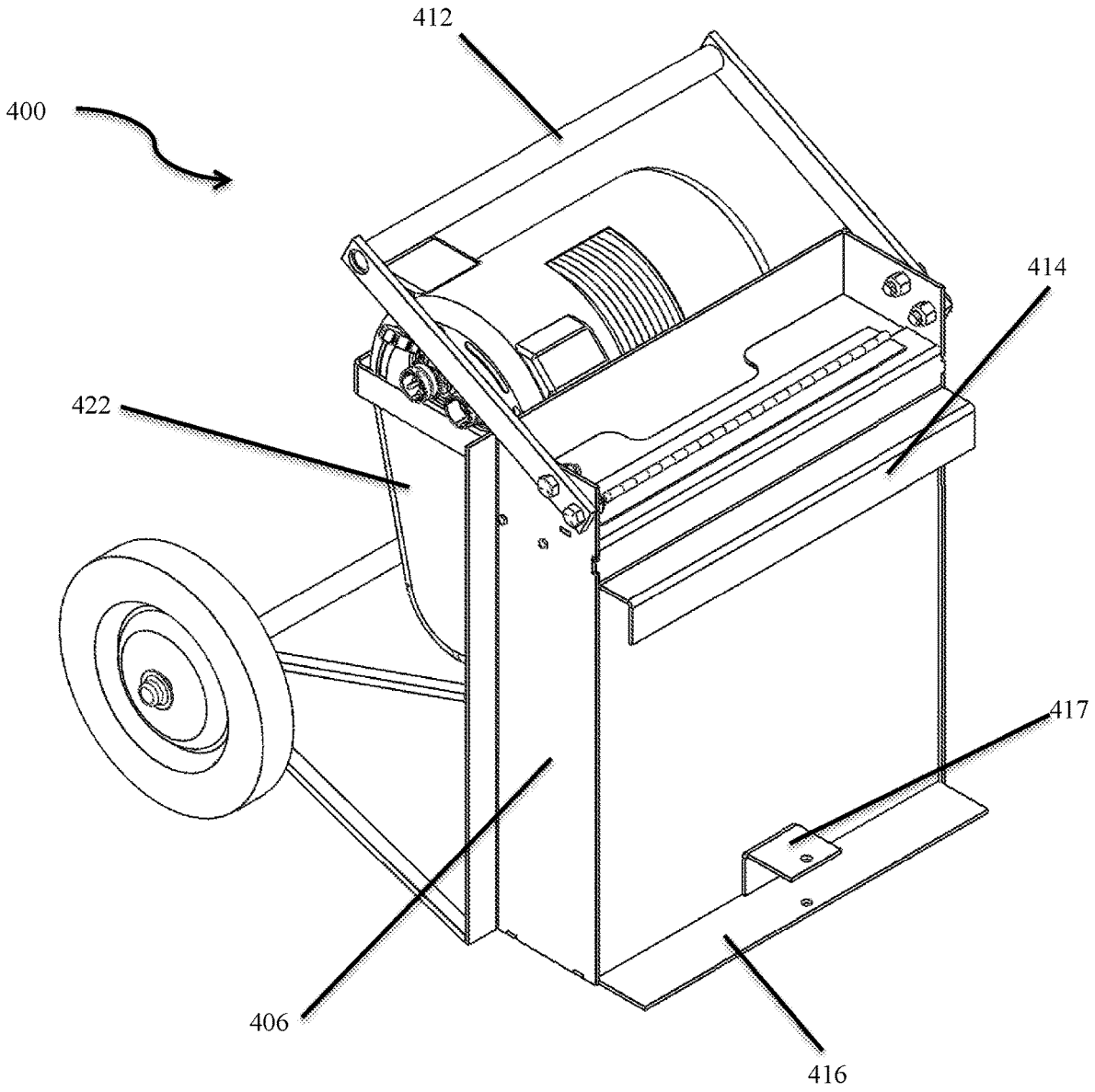
FIG. 4D is a perspective view of the front of the base assembly shown in FIGS. 4A, 4B and 4C.
Figure 4E:
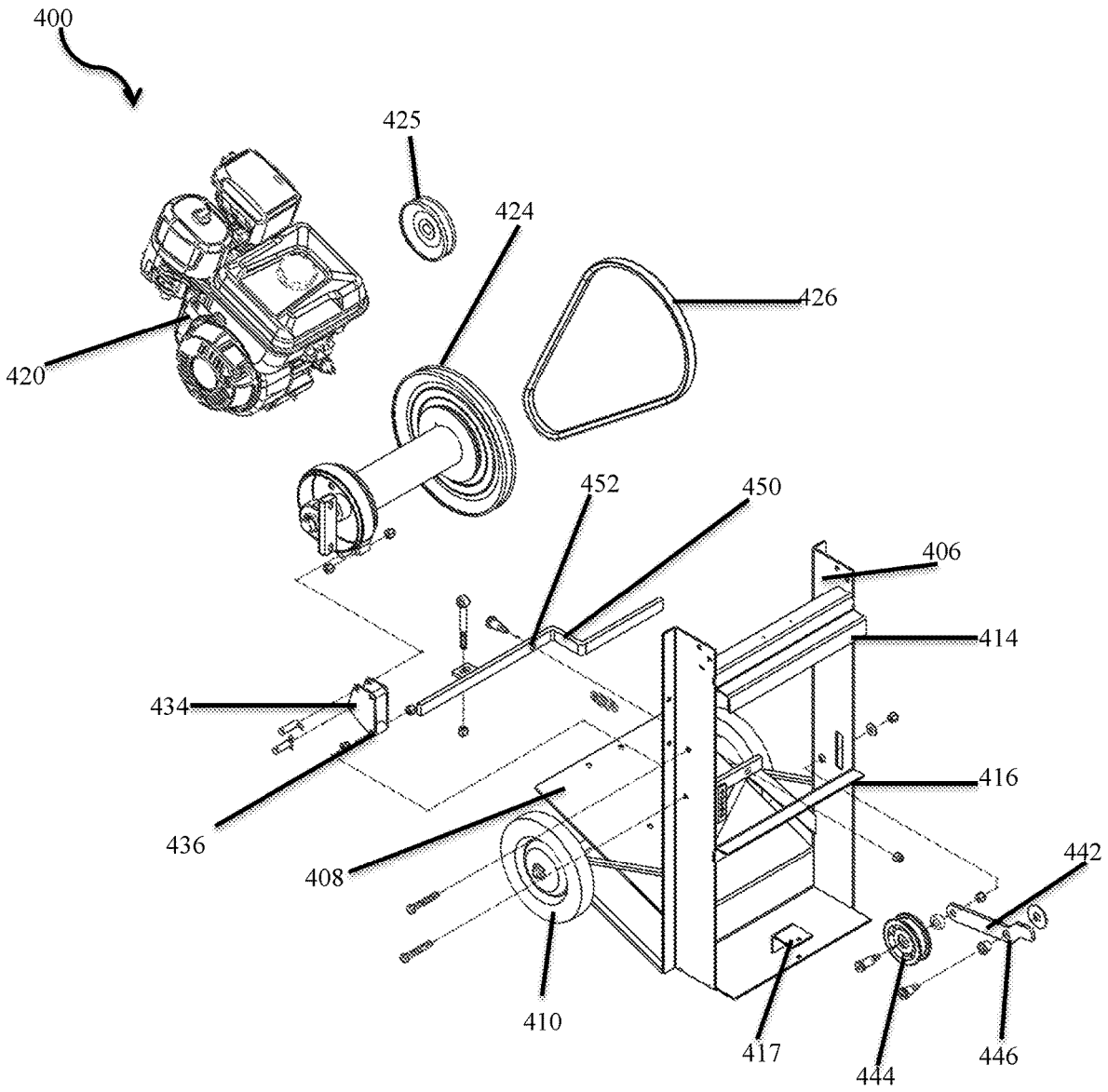
FIG. 4E is an exploded perspective view of one embodiment of a base assembly.
Figure 4F:
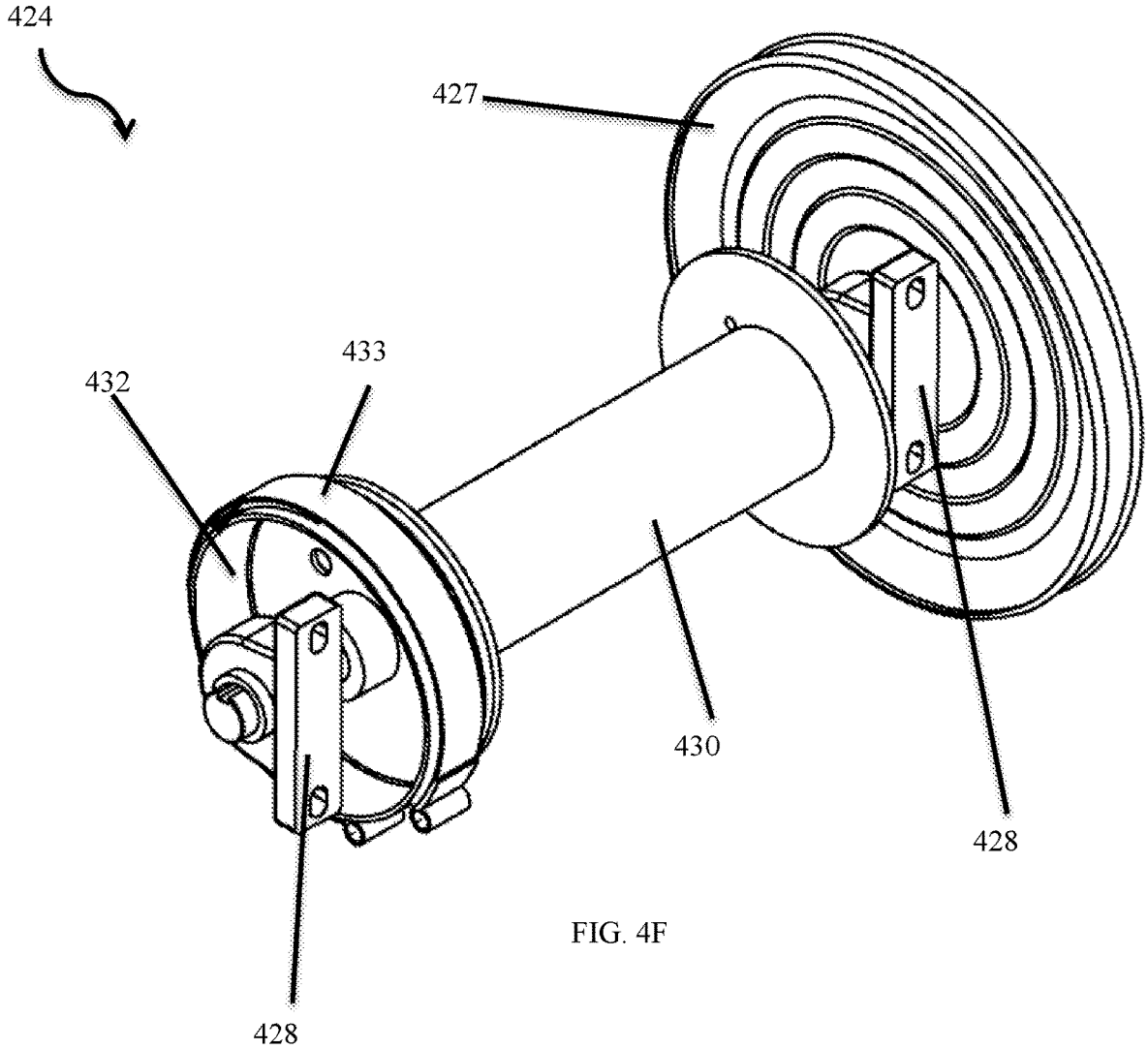
FIG. 4F is a perspective view of one embodiment of a winch drum assembly.
Figure 4G:
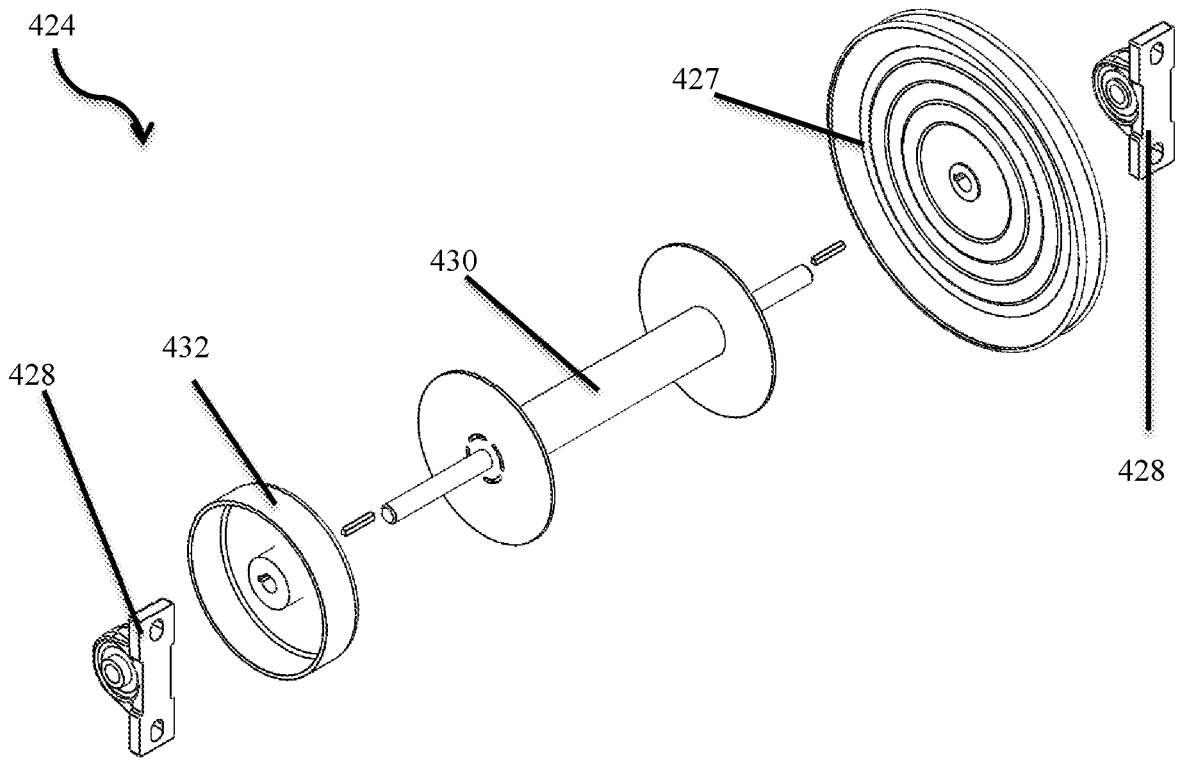
FIG. 4G is an exploded view of the winch drum assembly shown in FIG. 4F.
Figure 4H:
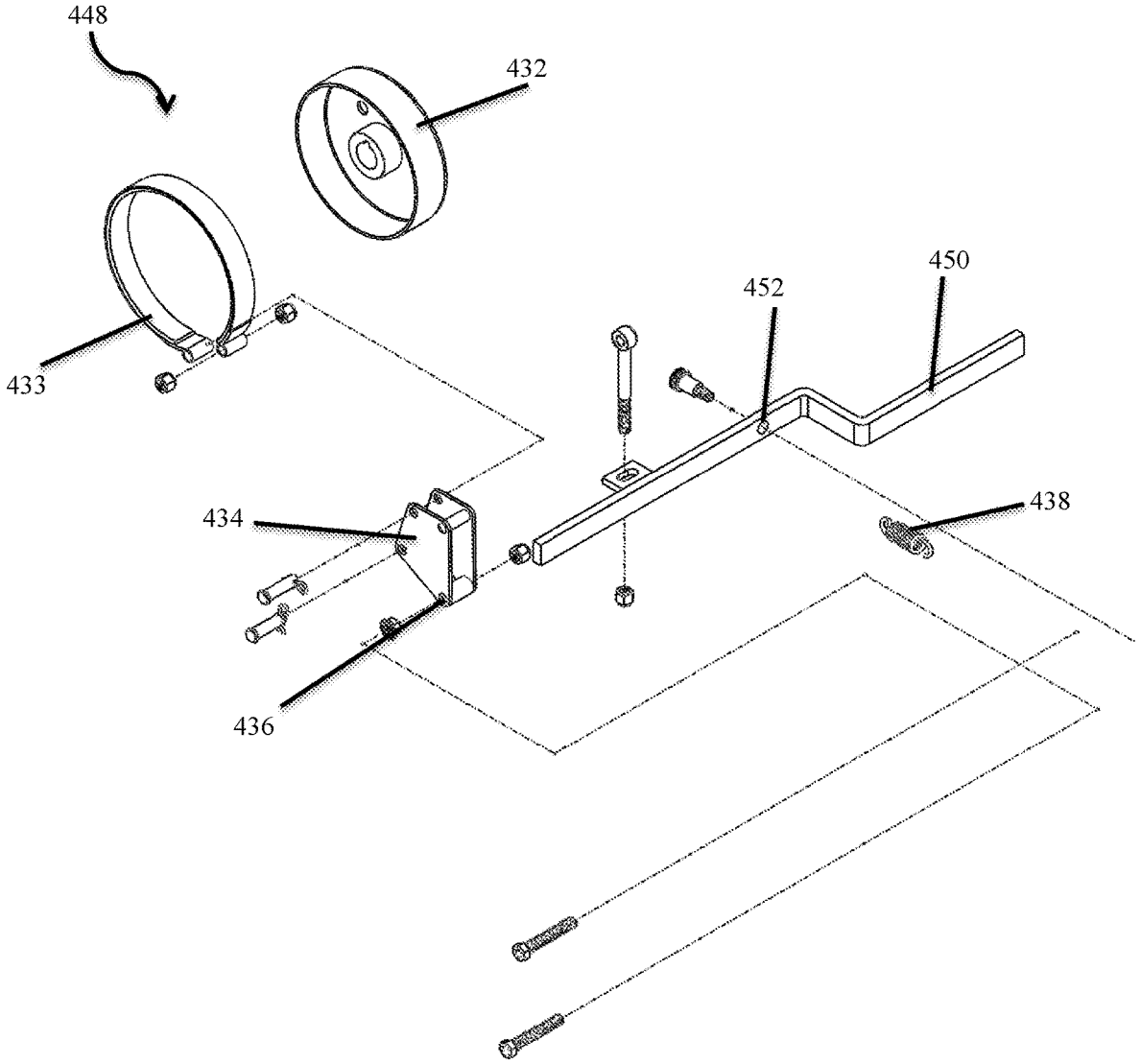
FIG. 4H is an exploded view of one embodiment of a primary braking system.
Figure 4I:
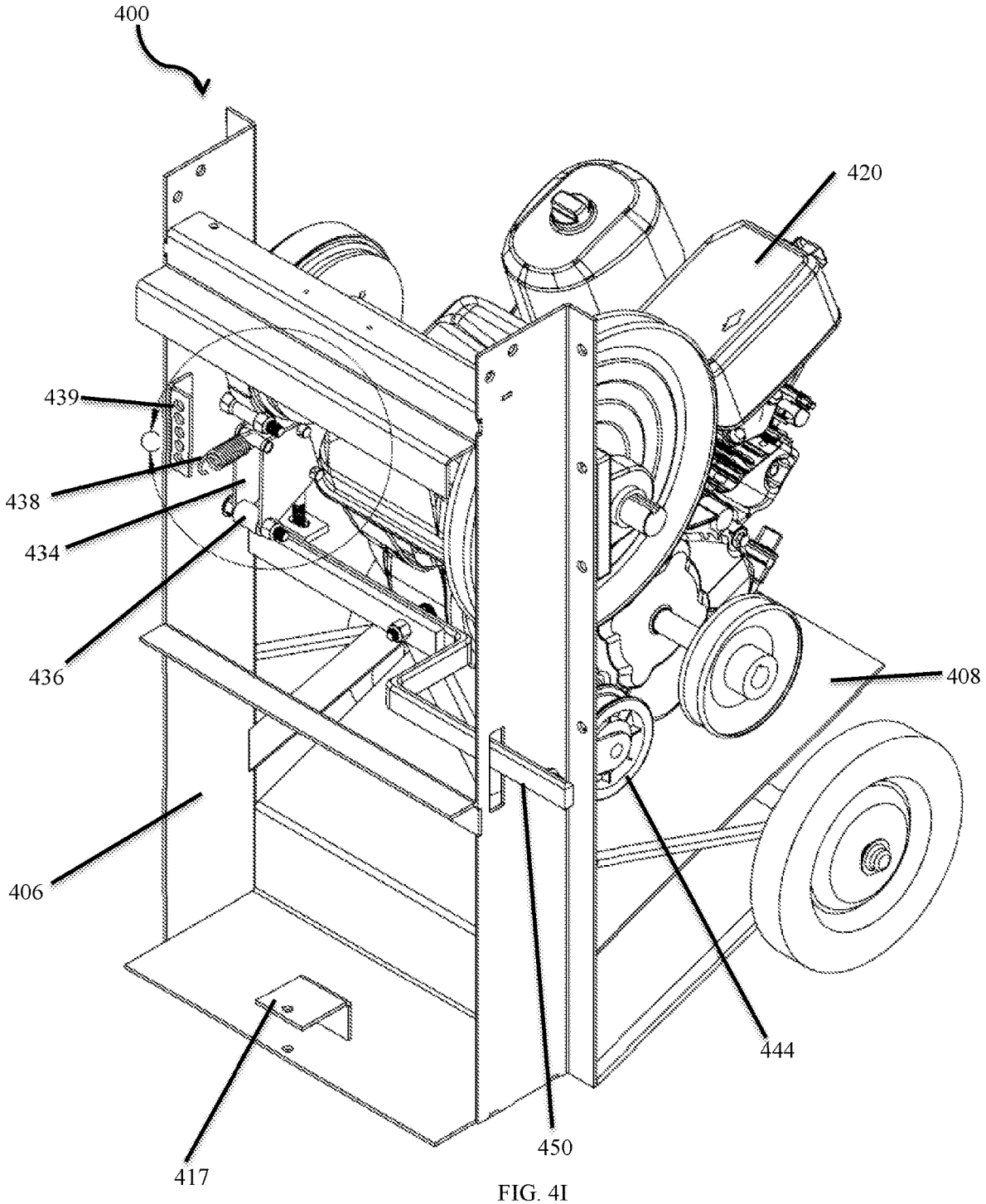
FIG. 4I is a perspective view of the base assembly shown in FIG. 4E.
Figure 4J:
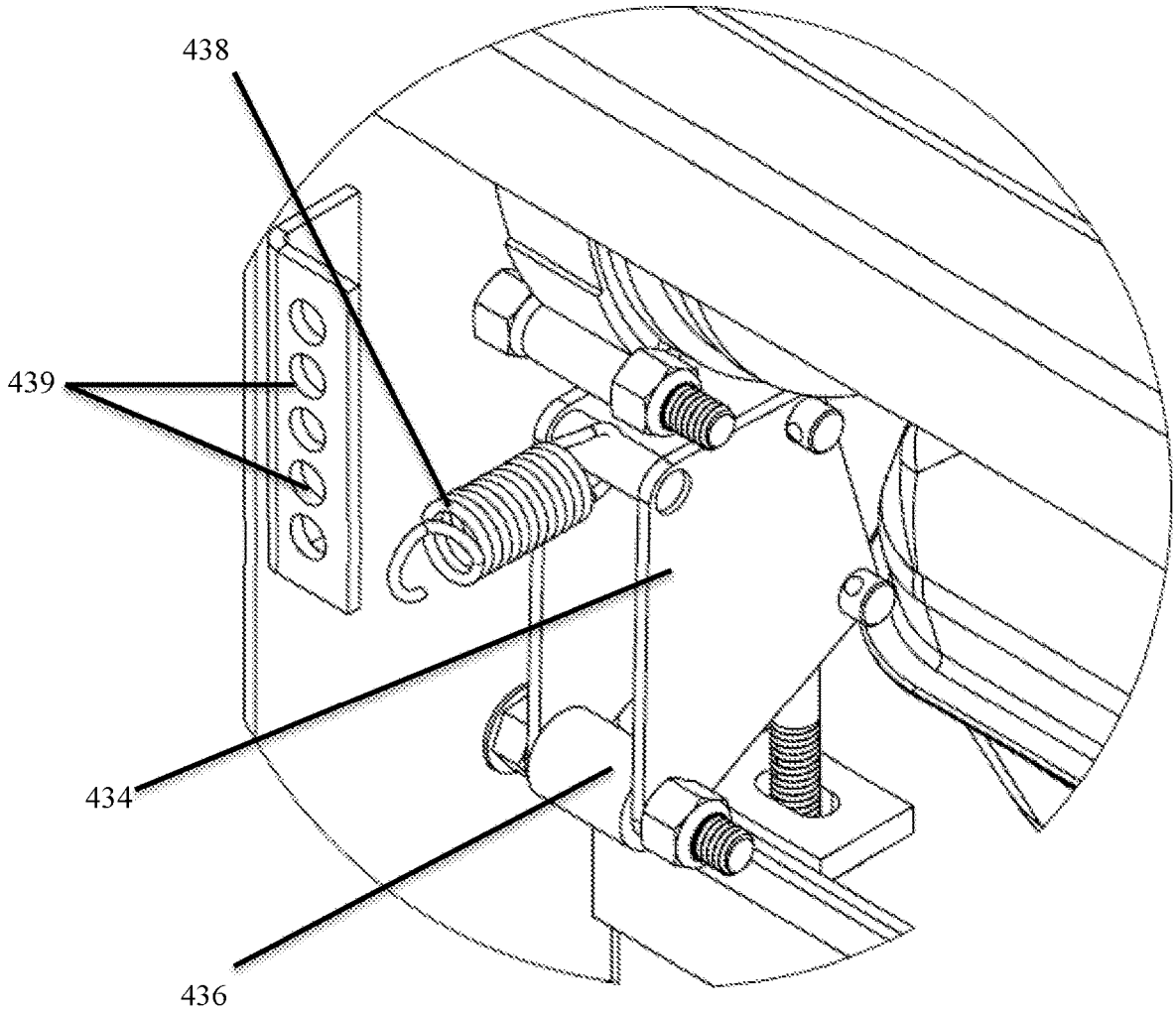
FIG. 4J is an magnified view of one embodiment primary brake assembly, highlighted in the circle "C" of FIG. 4I.
Figure 4K:
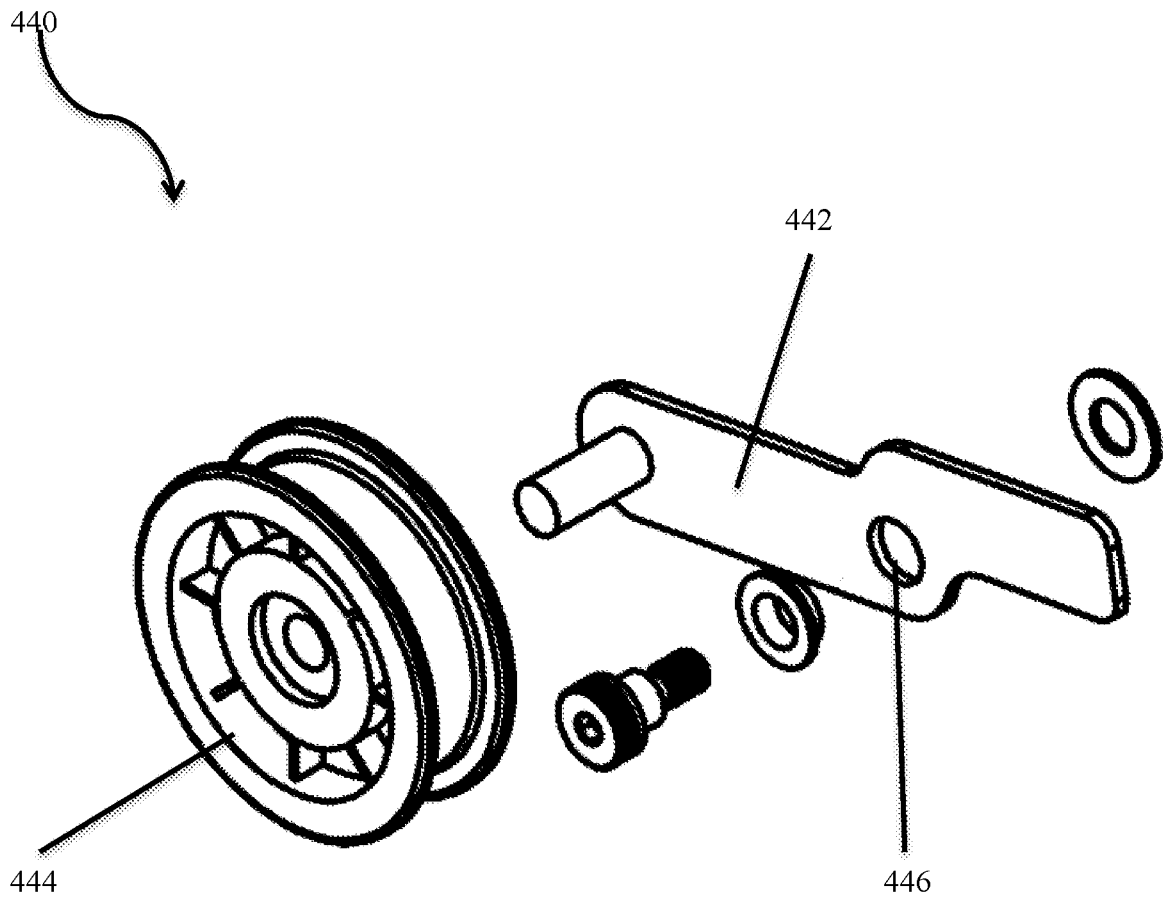
FIG. 4K is an exploded view of one embodiment of the idler pulley assembly.

Non-limiting embodiments of the peak 300 are depicted in FIGS. 3A and 3B. The peak 300 may include at least two extensions 302 which may be attached to either the interior or exterior of the side rails 104 with fasteners.

The peak 300 may also include at least one pulley 304 through which a cable may be looped. Such a pulley 304 may be aligned in a manner whereby a cable looped through the pulley 304 remains on the same side of the rungs 106 of the track 102 (e.g., the cable is in front of the track 102 going up and down). Conversely, the pulley 304 may be aligned in such a manner that the cable may go up on one side of the rungs 106 of the track 102 and go down the opposite side of the rungs 106 (e.g., the cable goes up the back side of the rungs 106 and down the front side of the rungs 106). The pulley 304 may also be positioned anywhere between the extensions 302. In one embodiment, the pulley 304 is substantially centered between the extensions 302.

The peak 300 may also include at least one hook 306 to which a cable may be anchored or fastened. The hook 306 may be positioned anywhere between the extensions 302. In certain embodiments, the hook 306 may be substantially centered between the pulley 304 and an extension 302. In certain embodiments the hook 306 permits the cable to run up the back side of the track 102 around the pulley 304 down the front side of the track 102 around the force transfer element 512, and back up the front side of the track 102 to the hook 306. Conversely, the hook 306 may be aligned in such a manner that the cable runs up the front side of the track 102 around the pulley 304 down the back side of the track 102 around the force transfer element 512, and back up the back side of the track 102 to the hook 306.

Base Assembly

One aspect of the present invention is directed to a base assembly 400. Non-limiting embodiments of the base assembly 400 are depicted in FIGS. 4A, 4B, 4C, 4D, 4E, and 4I. The base assembly 400 may be attached to the track 102 or removably attached to the track 102. In one embodiment, the base assembly is attached to the bottom of the track 102 so as to provide an anchor point for raising or lowering the carriage 200.

The base assembly 400 contains a base frame 406. Optionally, a base surface 408 may project out from the base frame 406. In a non-limiting embodiment, the base surface 408 projects out from one end of the base frame 406.

Base wheels 410 may be attached to the base frame 406 or the base surface 408. Such base wheels 410 may assist in transporting the base assembly 400.

In a non-limiting embodiment, a handle 412 may project out from the base frame 406 or the base surface 408 as well. Such a handle 412 may assist in transporting the base assembly 400. In a non-limiting embodiment, the handle 412 projects out from the base surface 408 in the same general direction as the base surface 408 or out from the base surface 408 in the same general direction as the base frame 406.

The base frame 406 may also have hooks 414, projections 416, or anchor points 417. Such hooks 414, projections 416, or anchor points 417 may assist in removably attaching the base assembly 400 to the track 102. For example, the hooks 414, projections 416, or anchor points 417 may releasably engage the rungs 106 of the track 102. The hooks 414, or projections 416 may contain base anchor point 417 through which fasteners may pass so as to further secure them to the track 102.

Power Unit

A power unit 418 may be attached to either the base frame 406 or the base surface 408. The power unit 418 may be either an internal combustion engine 420 or an electric motor 422. The engine 420 may include a gear reduction transmission or pulley which may increase or decrease the output speed of the engine 420. The motor may contain a remote control receptacle 421 or a power receptacle 423. In a non-limiting embodiment, the motor 422 contains both a remote control receptacle 421 and a power receptacle 423 on the same side.

The positioning of the power unit 418 relative to the base frame 406 and the base surface 408 may be fixed. Indeed, the power unit 418 may be removably attached to either the base frame 406 or the base surface 408.

In one embodiment, the power unit 418 is an electric motor 422. In such an embodiment, limit switches 600, which are typically contained within the motor housing, are remotely located. For example, the up limit switch 600 may be located on the peak 300 to prevent the carriage 200 from overrunning the top of the track 102. Conversely, the down limit switch may be located on the base assembly 400 which may prevent the carriage 200 from over running the bottom of the track 102.

In one embodiment, the incorporation of the electric motor 422 may increase operator safety because an operator can not only control the ascent of the carriage 200, but also the descent of the carriage 200. In addition, electric motors 422 are also typically quieter and provide a smaller carbon footprint than typical internal combustion engines.

Modular Winch Drum

The engine 420 may be connected to a winch drum assembly 424 by a drive wheel 425 connected to a drive belt 426 connected to a winch drum sheave 427. The winch drum assembly 424 may be releasably connected to either the base frame 406 or the base surface 408 with a pillow block bearing 428. Such winch fasteners may be, for example, pillow block bearings. The winch drum assembly 424 includes a cable drum 430, a brake drum 432, a winch drum sheave 427, and a brake band 433 connected to a winch brake pivot assembly 434. The cable is attached to the cable drum 430.

The cable drum 430 may be modular allowing it to be replaced with a cable drum 430 rated for higher or lower loads depending on the needs of the operator. For example, an operator may shift between load ratings by: (1) removing the pillow block bearing 428 closest to the brake drum; (2) removing the brake drum 432, brake band 433, and the winch brake pivot assembly 434; (3) switching the original cable drum 430 with a second cable drum 430; (4) reattaching the brake drum 432, brake band 433, the winch brake pivot assembly 434 and pillow block bearing 428.

The winch brake pivot assembly 434 may be connected to the base frame 406 or the base surface 408 at a winch brake pivot point 436. The winch brake pivot assembly 434 may be further connected to a winch brake spring element 438, which may be attached to the base frame 406 or the base surface 408.

The winch brake pivot assembly 434 is adapted to be moved between a first position and a second position. When the winch brake pivot assembly 434 is in the first position, the winch brake pivot assembly 434 may cause the brake band 433 to contact the brake drum 432, which may prevented the winch drum assembly 424 from rotating in one direction, however, as a result of slip the winch drum assembly 424 may rotate in the opposite direction. However, when the winch brake 434 is in the second position, the winch brake pivot assembly 434 may not cause the brake band 433 to contact the brake drum 432, and the winch drum assembly 424 may rotate freely in both directions.

In one embodiment, the spring element 438 applies a force on the winch brake pivot assembly 434 in the direction of the first position. In another embodiment, the spring element 438 may be anchored to the base frame 406 or base surface 408 at an anchor point 439. Furthermore, the base frame 406 or base surface 408 may contain multiple anchor points 439 which may permit the force the spring element 438 applies on the winch brake pivot assembly 434 to be adjusted based on the needs of the operator.

The winch brake pivot assembly 434 may also be connected to a reversible primary braking system 448 (e.g., the brake lever 450 may be adjustable so as to accommodate right handed or left handed operators). The reversible primary braking system 448 may apply a force on the winch brake pivot assembly 434 in the direction of the second position.

Idler Pulley

The base assembly 400 may also include a idler pulley assembly 440. The idler pulley assembly 440 may be connected to the base frame 406 or the base surface 408 on the side opposite the winch brake pivot assembly 434. Furthermore, the positioning of the idler pulley assembly 440 relative to the base frame 406 or the base surface 408 may be adjustable. Indeed, the idler pulley assembly 440 may be removably attached to either the base frame 406 or the base surface 408.

In one embodiment, the idler pulley assembly 440 contacts the drive belt 426 which increases the tension between the drive belt 426 and the winch drum assembly 424, thereby increasing the torque imparted by the engine 420 on the winch drum assembly 424.

The idler pulley assembly 440 includes a pivot arm 442 with an idler pulley 444 attached to one end of the pivot arm 442. The pivot arm 442 may be attached to the base frame 406 or the a base surface 408 at an idler pivot point 446. The pivot arm 442 is adapted to be moved between a first position and a second position. When the pivot arm 442 is in the first position, the idler pulley 444 does not contact the drive belt 426. Thus, torque is not applied to the winch drum assembly 424 and the carriage 200 does not ascend. However, when the pivot arm 442 is in the second position, the idler pulley 444 contacts the drive belt 426, thereby increasing the tension of the drive belt 426 resulting in torque being applied to the winch drum assembly 424 and the carriage 200 may ascend.

In one embodiment, the idler pulley assembly is in contact with a reversible primary braking system 448 and the reversible primary braking system 448 moves the pivot arm 442 between the first position and the second position.

Primary Brake System

Another aspect of the present invention is directed to a primary brake system 448 which includes a handle attached to a primary brake lever 450. The primary brake lever 450 may be connected to the base frame 406 or the base surface 408 at a primary brake pivot 452. The primary brake lever 450 may be attached or in contact with either the idler pulley assembly 440 or the winch brake pivot assembly 434.

The primary brake lever 450 is adapted to be moved between a first position, a neutral position, and a second position.

In one embodiment, when the primary brake lever 450 is in its neutral position the idler pulley assembly 440 and the winch brake pivot assembly 434 are both in the first position. As a result, the winch brake band 433 is engaged but the idler pulley assembly is not 440 (i.e., the carriage 200 does not ascend the track 102). Then, when the primary brake lever 450 is in the first position, the winch brake pivot assembly 434 is in the first position and the idler pulley assembly 440 is in the second position. As a result, although the winch brake band 433 is engaged, as a result of slip, the winch drum assembly 424 may rotate in the direction to wind the cable while the idler pulley assembly 440 applies torque to the winch drum assembly 424 (i.e. the carriage 200 travels up the track 102). Finally, when the primary brake lever 450 is in the second position, the idler pulley assembly 440 is in the first position and the winch brake pivot assembly 434 is in the second position. As a result, both the idler pulley assembly 440 and the winch band 433 are disengaged (i.e. the carriage 200 travels down the track 102).

Limit Switch

One aspect of the present invention is directed to a limit switch 600. The limit switch 600 is wired or wirelessly connected to the electric motor 422. In a non-limiting embodiment, the limit switch 600 includes a toggle 602.

In one embodiment, the limit switch 600 is attached close to the top of the track 102 and in a position where the carriage 200 may contact the toggle 602 as the carriage 200 moves up the track 102. The limit switch 600 is in wired or wireless communication with the electric motor 422. If the toggle 602 is tripped, the limit switch 600 alerts the electric motor 422, which ceases applying force up the track 102. As a result, the limit switch 600 prevents the carriage 200 from causing damage to the peak 300 or overrunning the top of the track 102.

In another one embodiment, the limit switch 600 is attached to the peak 300 and in a position where the carriage 200 may contact the toggle 602 as the carriage 200 moves up the track 102. The limit switch 600 is in wired or wireless communication with the electric motor 422. If the toggle 602 is tripped, the limit switch 600 alerts the electric motor 422, which ceases applying force up the track 102. As a result, the limit switch 600 prevents the carriage 200 from further ascending the track 102.

In a further embodiment, two limit switches are repositioned from inside the motor housing to a location that is outside the motor 422. For example, the up limit switch 600 may be located on the side of the carriage 200 closest to the peak 300. When the toggle is engaged by, for example, contacting the peak 300, the carriage 200 may be prevented from further ascending the track 102. Conversely, the down limit switch may be located on the base assembly 400. When the toggle is engaged by, for example, the carriage 200 contacting the base assembly 400, the carriage 200 may be prevented from further descending the track 102.

Remote

One additional aspect of the present invention is directed to a remote connected to the electric motor 422. The remote may be connected to the electric motor 422 by a wired or wireless communication. In an embodiment, the remote is a mobile computer device such as an mobile phone or tablet.

Through the use of the remote, the operator of the material transport apparatus 100 may control the electric motor 422 (i.e., raising or lowering the carriage 200) without the need to stand directly below the load. Such a repositioning of the worker may lessen the likelihood of the worker being injured or killed if a cable or primary brake failure causes a load to uncontrollably descend.

Assembly of Apparatus

The disclosed material transport apparatus 100 is intended to be assembled with standardized parts. As a result, first the necessary height of the track 102 is determined. If multiple track sections are required to reach the desired height, these sections are joined together with fasteners, using splice plates. Once a track 102 of the necessary height is obtained, the peak 300 is attached to the top of the track 102. Next a cable is strung from the base assembly 400 through the peak 300 and attached to the carriage 200. The track 102 is then lifted into position. For safety purposes, the track 102 is spaced at least one foot away from the structure wall for every four feet in height desired. Finally, the base assembly 400 is attached to the track 102.

Retrofitting Older Carriages

One additional aspect of the present invention is directed to a retrofit kit which may be used to attach the automatic emergency braking system 500 to an older model carriage. Indeed, one embodiment would attach the automatic emergency braking system 500 to a plate which could be aligned and then attached the older model carriage.

In some embodiments, the plate would be planar or substantially planar. In other embodiments, the plate may be contoured to fit over a surface of the older model carriage.

Materials Used in Manufacture

The material transport apparatus 100 may be constructed of materials known to those skilled in the art (e.g., metal, carbon fiber, plastic, wood, or composite materials). In one embodiment, the track 102 is made of aluminum, the peak 300 is made of aluminum or a metal that is harder than aluminum, and the brakes are made of a metal harder than aluminum.

EXAMPLE

The following example is included to more clearly demonstrate the overall nature of the invention. FIGS. 5A, 5B and 5C illustrate one embodiment of the automatic emergency braking system in its engaged and disengaged position. This example is exemplary, not restrictive, of the invention.

In the non-limiting embodiment depicted in FIGS. 5A, 5B, and 5C, when the cable becomes slack, the spring element 506, which is attached to the plate 508, causes the plate 508 to rotate about the pivot 510. The slide 514, connected to the plate 508, is pulled in an upward direction as the plate 508 rotates. In this embodiment, the slide 514 is allowed to float because it is held in place between four slide rollers 516. The brake arm 518 is attached to the slide 514. Braking elements 504 are attached to the brake arm 518. The slide 514 and all the attached components are pulled in an upward direction until the two braking elements 504, which are wedge shaped, contact a set of the wheels 212 (which may be carriage wheels). The braking elements 504 are made of steel. The side rails 104 are made of aluminum. The braking elements 504 are designed with serrations which bite into the softer aluminum side rails 104. As a result, the braking elements 504 are wedged between the wheels 212 and the side rails 104 they are riding on, preventing the carriage 200 from traveling beyond that point.

In summary, the present invention provides an environmentally friendly platform hoist that incorporates safety apparatuses that removes the operator from the fall zone and prevents carriage plunge when there is a cable or primary brake failure.

For added safety, one embodiment includes an automatic emergency braking system 500 which reduces the danger associated with operating the material transport apparatus 100. The engagement of the braking elements 504 occurs when the biasing element 502 moves from a first position to a second position. Whether the biasing element 502 moves to the first position or the second position depends on whether a cable is applying force in the direction of the length of the track 102 sufficient to overcome the force being applied on the biasing element 502 by the spring element 506. If the spring element 506 applies more force than the cable, the braking elements 504 are automatically applied. Conversely, if the cable applies more force than the spring element 506, then the braking elements 504 are disengaged. This added safety feature can be provided already attached to the carriage 200 or in a kit form to retrofit older carriages.

Another embodiment, incorporates an electric motor 422 which is not only safer design because an operator may control both the ascent and descent of the carriage 200, but is more environmentally friendly. In addition, electric motors 422 are also typically quieter and provide a smaller carbon footprint than typical internal combustion engines.

Another embodiment, includes a limit switch 600 in wired or wireless communication with the power unit. To increase operator safety and remove wires and other tripping hazards from around the base of the track 102 the carriage may include a retraction real 604 that will permit the wires connecting the limit switch 600 to the electric motor 422 to extend as the carriage 200 ascends the track 102, and retract into the retraction real 604 as the carriage 200 descends the track 102.

Although illustrated and described above with reference to certain specific embodiments, the present invention is nevertheless not intended to be limited to the details shown. Rather, various modifications may be made in the details within the scope and range of equivalents of the claims and without departing from the spirit of the invention. It is expressly intended, for example, that all ranges broadly recited in this document include within their scope all narrower ranges which fall within the broader ranges.

What is claimed is:

1. A material transport apparatus for use with a track having two rails, the apparatus comprising:

a carriage frame having a length and a width, the carriage frame comprising:

two trolley assemblies aligned along opposite lengths of the carriage frame, each trolley assembly including at least one truck assembly having a guide attached to a wheel configured to contact the rails, an anchor configured to accept a cable; and an automatic emergency braking system comprising:

at least two braking elements each aligned with a different wheel, and a biasing element connected to the braking elements and adapted to be moved between a first position and a second position by a pulling force substantially aligned in the direction of the length of the carriage frame, wherein when the biasing element is in the first position the braking elements do not contact the wheels and when the biasing element is the second position the braking elements contact the wheels; and a platform connected to and extending from the carriage frame.

2. The material transport apparatus of claim 1, wherein the biasing element is connected to the braking elements by a slide.

3. The material transport apparatus of claim 2, wherein the slide is connected to the braking elements by at least one brake arm.

4. The material transport apparatus of claim 1, wherein the braking elements are wedge shaped.

5. The material transport apparatus of claim 1, wherein the braking system elements are serrated.

6. The material transport apparatus of claim 1, wherein the braking elements are comprised of metal that is harder than aluminum.

7. The material transport apparatus of claim 1, wherein the biasing element comprises:

a plate connected to the carriage frame at a pivot, the plate comprising:

a force transfer element adapted to contact the cable and transfer force applied by the cable substantially in the direction of the length of the carriage frame onto the plate in the direction of the first position; and a spring element that applies constant force on the plate in the direction of the second position.

8. The material transport apparatus of claim 7, wherein the force transfer element is a pulley.

9. The material transport apparatus of claim 1, wherein at least one of the length or width of the carriage frame is adjustable.

10. The material transport apparatus of claim 1, further comprising a flap connected to and extending from the platform.

11. A material transport apparatus comprising:

a track comprising:

at least two rails, a peak connecting the rails at one end of the track, and a pulley connected to the peak;

a carriage frame having a length and a width, the carriage frame comprising:

two trolley assemblies aligned along opposite lengths of the carriage frame, each trolley assembly including at least one truck assembly having a guide attached to a wheel configured to contact the rails, an anchor configured to accept a cable; and an automatic emergency braking system comprising:

at least two braking elements each aligned with a different wheel, and a biasing element connected to the braking elements and adapted to be moved between a first position and a second position by a pulling force substantially aligned in the direction of the length of the carriage frame, wherein when the biasing element is in the first position the braking elements do not contact the wheels and when the biasing element is the second position the braking elements contact the wheels; and a platform connected to and extending from the carriage frame.

12. The material transport apparatus of claim 11, wherein the track further comprises a limit switch adapted to prevent the carriage from contacting the peak.

13. The material transport apparatus of claim 11, wherein the track further comprises feet on end of the rails opposite the peak.

14. The material transport apparatus of claim 13, wherein the length of the feet are independently adjustable.

15. The material transport apparatus of claim 11, further comprising a base assembly connected to the track opposite the peak.

16. The material transport apparatus of claim 15, wherein the base assembly comprises a motor connected to a drive belt, the drive belt connected to a spool, and a manual brake system connected to the spool.

17. The material transport apparatus of claim 16, wherein the motor is electrical or gas powered.

18. The material transport apparatus of claim 16, wherein the location of the motor relative to the spool can be adjusted.

19. The material transport apparatus of claim 16, further comprising a remote configured to control the motor.

20. A material transport apparatus comprising:

a track comprising:

at least two rails, a peak connecting the rails at one end of the track, and a pulley connected to the peak;

a carriage frame having a length and a width, the carriage frame comprising:

two trolley assemblies aligned along opposite lengths of the carriage frame, each trolley assembly including at least one truck assembly having a guide attached to a wheel configured to contact the rails, an anchor configured to accept a cable; and an automatic emergency braking system comprising:

at least two braking elements each aligned with a different wheel, and a biasing element connected to the braking elements and adapted to be moved between a first position and a second position by a pulling force substantially aligned in the direction of the length of the carriage frame, wherein when the biasing element is in the first position the braking elements do not contact the wheels and when the biasing element is the second position the braking elements contact the wheels; and a platform connected to and extending from the carriage frame; and a base assembly connected to the track opposite the peak, the base assembly comprising:

an electrical motor or gas engine connected to a drive shaft, the drive shaft connected to a spool, a manual brake system also connected to the spool, and a remote configured to control the motor or engine.

* * * * *